US007125105B2

(12) United States Patent
Oomura

(10) Patent No.: US 7,125,105 B2
(45) Date of Patent: Oct. 24, 2006

(54) SEMICONDUCTOR DEVICE FOR LIQUID EJECTION HEAD, LIQUID EJECTION HEAD, AND LIQUID EJECTION APPARATUS

(75) Inventor: Masanobu Oomura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 10/933,379

(22) Filed: Sep. 3, 2004

(65) Prior Publication Data

US 2005/0052499 A1 Mar. 10, 2005

(30) Foreign Application Priority Data

Sep. 8, 2003 (JP) ..... 2003-315532

(51) Int. Cl.
*B41J 2/05* (2006.01)

(52) U.S. Cl. ..... 347/58; 347/59

(58) Field of Classification Search ..... 347/20, 347/56–59, 61, 62, 63
See application file for complete search history.

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/56 |
| 4,459,600 | A | 7/1984 | Sato et al. | 347/47 |
| 4,463,359 | A | 7/1984 | Ayata et al. | 347/56 |
| 4,558,333 | A | 12/1985 | Sugitani et al. | 347/65 |
| 4,723,129 | A | 2/1988 | Endo et al. | 347/56 |
| 4,740,796 | A | 4/1988 | Endo et al. | 347/56 |
| 5,172,134 | A * | 12/1992 | Kishida et al. | 347/58 |
| 6,102,510 | A * | 8/2000 | Kikuta et al. | 347/57 |
| 6,290,334 | B1 | 9/2001 | Ishinaga et al. | 347/59 |
| 6,474,789 | B1 | 11/2002 | Ishinaga et al. | 347/59 |

FOREIGN PATENT DOCUMENTS

| | | |
|---|---|---|
| JP | 59-123670 | 7/1984 |
| JP | 59-138461 | 8/1984 |
| JP | 5-185594 | 7/1993 |
| JP | 8-108536 | 4/1996 |
| JP | 11-129479 | 5/1999 |

* cited by examiner

*Primary Examiner*—Juanita D. Stephens
(74) *Attorney, Agent, or Firm*—Fitzpatrick, Cella, Harper & Scinto

(57) ABSTRACT

A semiconductor device constituting a liquid ejection head for ejecting a liquid such as an ink, comprising a segment having a plurality of pairs of recording element and driving element, wherein a first wiring for mutually connecting a first terminal of each driving element arranged within the same segment is formed on a first wiring layer on a semiconductor substrate, and a second terminal of the driving element and a first terminal of the recording element are connected on one for one base, and a second terminal of the recording element is connected to a power source wiring formed by the wiring layer different from the first wiring layer, and an auxiliary wiring for mutually connecting the second terminal of the recording element with the same segment is formed by the first wiring layer, thereby eliminating and suitably adjusting the irregularity of wiring resistance values within the segment.

15 Claims, 18 Drawing Sheets

SEMICONDUCTOR DEVICE FOR LIQUID EJECTION HEAD, LIQUID EJECTION HEAD, AND LIQUID EJECTION APPARATUS

BACKGROUND OF THE INVENTION

1. Field of the Invention

The present invention relates to a semiconductor device for a liquid ejection head used for constituting a liquid ejection head for ejecting a liquid such as, for example, ink, and a liquid ejection head and a liquid ejection apparatus using such a semiconductor device for a liquid ejection head.

2. Related Background Art

A liquid ejection head for ejecting a liquid from an ejection orifice issued as a recording head of an ink jet system by using, for example, ink as a liquid and controlling an ejection of ink according to recording signals and adhering the ink on a recording medium. Further, the liquid ejection apparatus comprising such a liquid ejection head is, for example, applied as an ink jet recording apparatus.

Here, describing a recording method of the ink jet system, the ink jet recording method (liquid jetting recording method) is capable of a high speed recording to the extent that a generation of noises at an operating time is extremely small to be negligible, and moreover, it is extremely excellent to the extent that a recording can be made on a so-called plain paper without requiring special processing such as a fixing and the like, and therefore, recently it is becoming a mainstream of the printing system. In particular, in an ink jet recording head using thermal energy, heat energy generated by electrothermic exchanger (heater) is given to a liquid to selectively induce a bubbling phenomenon in the liquid, thereby allowing an ink liquid droplet to eject from the ejection orifice by its bubbling energy.

FIG. 13 shows a circuit structure of the recording head to be mounted on the ink jet system recording apparatus, which represents the conventional liquid ejection head. An electrothermic exchanging element (heater) and its drive circuit of this type of the recording head as disclosed, for example, in Japanese Patent Application Laid-Open No. H05-185594 can be formed on the same silicon semiconductor substrate by using a semiconductor processing technology.

As shown in FIG. 13, on the semiconductor substrate, there are provided a plurality of heaters (electrothermic exchanging elements) 101 for generating heat for ejecting an ink, and an n type power transistor 102 is connected to each heater 101 in order to supply a desired current to the heater 101. The one end of each heater 101 is commonly connected to a heater power source line VH, and the other end of each heater 101 is connected to a drain of the corresponding n type power transistor 102. The source of each n type power transistor 102 is connected to a ground line GNDH, respectively. Further, a shift register 116 is commonly provided for a plurality of these heaters 101 for supplying the current to each heater 101 and temporarily storing an image data to decide whether or not the ink is ejected from a nozzle (ejection orifice) of the recording head. The shift register 116 is provided with an input terminal to be inputted with a transfer clock signal CLK and an image data input terminal in which an image data DATA to turn ON and OFF the heater 101 is inputted in serial form. Each stage of the shift resister 116 corresponds to one each heater 101, respectively, and the output of each stage of the shift resister 116 is connected to a latch circuit 115 for recording and maintaining the image data for each heater 101 for every heater. Each latch circuit 115 inputs the output of the shift resistor 116, and at the same time, comprises a latch signal input terminal for inputting a latch signal LT for controlling latch timing. The latch signal LT is commonly inputted to each latch circuit 115. On the output side of each latch circuit 115, there is provided an AND circuit 114, respectively. The AND circuit 114 takes the output of the latch circuit 115 and a heat signal HE for deciding a timing to let the current flow to the heater 101 as an input. The heat signal HE is commonly inputted to each of the AND circuit 114, respectively. The output of the AND circuit 114 is inputted to the gate of the power transistor 102 connected to the corresponding heater 101 through a level conversion circuit 103. The level conversion circuit 103 is a circuit which converts the signal of a so-called theoretical level into a signal of amplitude of voltage capable of controlling the gate of the power transistor 102.

Here, the n type power transistor is a field-effect transistor, and for example, it is an nMOS transistor or a n type DMOS (Double Diffused MOS}.

Describing a circuit structure of the level conversion circuit 103, there are provided a first inverter circuit 208 for inverting the image data from the AND circuit 114 and a second inverter circuit 207 for further inverting a signal outputted from the first inverter circuit 208. The level conversion circuit 103 is supplied with a power from an inner power source line VHTM outputted from a voltage generating circuit 117. Further, in the level conversion circuit 103, the output of the second inverter circuit 207 is inputted to a first CMOS inverter circuit comprising a pMOS transistor 202 and an nMOS transistor 203. The source of the pMOS transistor 202 is connected to a first buffer pMOS transistor 201 for dividing a voltage supplied from the inner power source line VHTM to enable a first CMOS inverter circuit to be driven by a signal below 5V (a power source voltage of a logic unit is generally below 5V) which is an output voltage of the AND circuit 114. Similarly, there is provided a second CMOS inverter circuit, which comprises a pMOS transistor 205 and an nMOS transistor and is inputted with the output of the first inverter circuit 208, and the source of the pMOS transistor 205 is connected to a second buffer pMOS transistor 204. Here, the gate of the first buffer pMOS transistor 201 is connected to a connecting portion of a pair of transistors 205 and 206 which is the output portion of the second CMOS inverter circuit. Similarly, the gate of the second buffer pMOS transistor 204 is also connected to a connecting portion of a pair of transistors 202 and 203 which is the output portion of the first CMOS inverter circuit. The connecting portion of the transistors 205 and 206 is connected to the gate of the corresponding power transistor 102 as the output of the level conversion circuit 103.

It is desirable that an output voltage VHTM of the voltage generating circuit 117 does not exceed a breakdown withstand pressure of the CMOS inverter and the gate withstand pressure of the MOS transistor, but is set as much high as possible. If possible, the output voltage VHTM may be shared with the power source line VH for each heater 101. However, in an ordinary case, the driving voltage to each heater 101 is often set at a high value of 20V or more, while, on the other hand, the CMOS inverter is often fabricated by a semiconductor processing such as having its breakdown withstand voltage up to 15V. Further, since the gate withstand pressure of the MOS transistor depends on the thickness of a gate oxide film, the voltage applied to the gate of the MOS transistor is required to be a voltage sufficiently lower than the insulated withstand voltage of the gate oxide film. Therefore, it is difficult to match the optimum power source voltage (that is, the voltage VHTM) in the level conversion circuit 103 to the driving voltage (the voltage VH) of each heater 101. As a matter of fact, the additional provision of the power source line of the level conversion circuit 103 is conductive to a cost up of the whole system.

Hence, the conventional technology realizes the voltage generating circuit 117, for example, by a circuit structure as shown in FIG. 14. The circuit shown in FIG. 14 is constituted such that resistors R3 and R1 are connected in series between the power source line VH and a ground point, and an arbitrary voltage is prepared from the power line VH of the heater by a ratio of partial pressure of the resistors R3 and R1, to which a source follower circuit consisting of the nMOS transistor T1 as a buffer and a resistor R2 is connected, and the source of the nMOS transistor T1 is taken as an output end of the voltage generating circuit 117.

The circuit structure and the like as described above are disclosed in Japanese Patent Application Laid-Open No. H11-129479. As described above, the heater 101, the drive circuit and the like for driving the heater 101 are integrally provided, for example, on a silicon semiconductor substrate. Hence, the arrangement and the layout of each circuit portion on the silicon semiconductor substrate which constitutes the recording head will be described. FIG. 15 is a view to show one example of the layout of each circuit portion on the silicon semiconductor substrate. This is disclosed in Japanese Patent Application Laid-Open No. H08-108536.

In the silicon semiconductor substrate 150 having an approximate rectangular shape, there are arranged a plurality of heaters 101 so as to be alongside the one long side of the substrate, and each heater 101 is connected to the power transistor 102, respectively. In the drawing, the whole of the forming region of a plurality of power transistors 102 provided in such a manner is shown by a rectangular region 122. As illustrated, adjacent to the forming region (heater unit) of the heaters 101, the forming region 122 of the power transistors is arranged. Further, a drive logic circuit unit 123 in which a group of logic circuits including the level conversion circuits 103 and the shift resistor 116 shown in FIG. 13 are provided is provided adjacent to the forming region 122 of the power transistors at the side opposite to the forming region of the heaters 101. Though not illustrated, the drive logic circuit unit 123 is also connected to a wiring for supplying the transfer clock signal CLK, the image data DATA, the latch signal LT, and the heat signal HE.

The forming region 122 of the power transistors is connected to a power source line (power source wiring) 105 for applying a predetermined voltage to the heater 101, and the drive logic circuit unit 123 is connected to a GND (ground) line (GND wiring) 110 in which the current from the power transistor is let flow. Consequently, the power source line 105 corresponds to the power source line of the VH in FIG. 13, and the GND line 110 corresponds to the GNDH line. Though not illustrated, the drive logic circuit group 123 is also connected to the wiring for supplying the transfer clock signal CLK, the image data DATA, the latch signal LT, and the heat signal HE. Here, the power source line 105 is formed in such a manner as to be arranged on the element of each power transistor 102 by an aluminum wiring in a second layer in the semiconductor substrate 150 formed by a multi-layer wiring technology. On the other hand, a signal line and the like connected to the power transistor 102 are formed by the aluminum wiring in a first layer in the semiconductor substrate 150, and are electrically insulated from the power source line 105. In the present specification, the terminology of the aluminum wiring includes a wiring layer comprising an alloy including aluminum in addition to a wiring layer comprising a pure aluminum according to the common practice in the field of the manufacturing process of the semiconductor device. The terminology of the first layer and the second layer is used in such a manner as to define a layer close to the main body of the silicon semiconductor substrate as the first layer with the surface side defined as the second layer.

A wiring 106 is a wiring to connect the power source line 105 and the heater 101, and is directly connected by the aluminum wiring of the second layer in the semiconductor substrate 150. Further, a wiring 107 is a wiring to connect the heater 101 and the power transistor 102, and is formed by the aluminum wiring of the first layer of the semiconductor substrate 150. By providing the wirings 106 and 107 in this manner, the wiring 107 is passed through the underside of the power source line 105 which is the aluminum wiring of the second layer, and the power transistor 102 and the heater 101 can be directly connected. On the other hand, the GND line 110 is formed by the aluminum wiring of the second layer in the semiconductor substrate 150, and is arranged on each element constituting the drive logic circuit unit 123. On the other hand, the signal line and the like within the drive logic circuit unit 123 are formed by the aluminum wiring of the first layer, and is electrically insulated from the GND line 110. On the end portion of the power source line 105, there is provided a power source bonding pad 111, and on the end portion of the GND line 110, there is providing a GND bonding pad 112. In the example shown here, any of the power source line 105 and the GND line 110 is allowed to be pulled out to both of the left and right end sides of the semiconductor substrate 150, and at both of the left and right end sides, there are formed bonding pads 111 and 112.

However, in the above described recording head, when all the heaters 101 and power transistors 102 are connected to the VH wiring (power source line 105) and the GNDH wiring (GND line 110), with respect to the heaters arranged at the end of the heater unit and the heaters arranged at the center of the heat unit, a wiring resistance reaching those heaters is different. That is, depending on the position in the heater unit, the wiring resistance reaching that heater is different, and assuming that the driving voltage of the heater is constant, it is sometimes not possible to supply the same power to all the heaters. When a sum of the resistance between the VH wiring and the GND wiring, the wiring resistance, the heater resistance, and the ON resistance of the power transistor is different depending on the location of the heater, it is not possible to supply the same current value to all the heaters. Although a predetermined calorific value needs to be obtained even in the heater where the current to be supplied becomes the smallest, if the driving condition is set in such a manner, an excessive drive current is let flow in other heaters, and this ends up shortening the life of those heaters.

Further, the problem arising from the wiring resistance being not uniform noticeably emerges when the number of heaters arranged on the semiconductor substrate is increased with the recording head continuously lengthened or when the width of the power source line and the GND line are made small so as to shorten the length of the short side portion of the recording head.

Therefore, an object of the present invention is to provide a liquid ejection head semiconductor device, which is a semiconductor device for constituting the liquid ejection head represented by an ink jet recording head, wherein the irregularity of wiring resistance for each of a plurality of recording elements (for example, heaters) provided within this semiconductor device is made small, thereby preventing an excessive drive current from occurring in the recording elements.

Another object of the present invention is to provide a liquid ejection head and a liquid ejection apparatus using such a liquid ejection head semiconductor device.

SUMMARY OF THE INVENTION

The semiconductor device for a liquid ejection head of the present invention is a semiconductor device in any event having a plurality of recording elements and driving elements for driving the recording elements provided and accommodated for every recording elements, which has at least a first wiring layer and a second wiring layer formed on a semiconductor substrate, and segments are formed by a plurality of pairs of the recording elements and the driving elements, and a first wiring for mutually connecting and grounding first terminals of the driving elements arranged in the same segment is formed in the first wiring layer, and a second terminal of the driving element and the first terminal of the recording element are connected on a one for one base, and a power source wiring is formed in the second wiring layer at the second terminal of the recording element so that the current is let flow into the recording element by a control signal inputted to a third terminal of the driving element, and at the same time, an auxiliary wiring for mutually connecting the second terminal of the recording element arranged within the same segment is formed in the first wiring layer.

The present invention, as evident from the following description, provides the auxiliary wiring in the semiconductor device manufactured by using a multi-layer wiring technology in the semiconductor manufacturing process, so that the irregularity of the wiring resistance for each recording element in the segment can be made small.

The liquid ejection head semiconductor device of the present invention is preferably used for an ink jet recording head for performing a recording by giving heat energy to an ink and allowing an ink droplet to eject from an ejection orifice.

In the present invention, typically, the recording element is a heater, and the driving element is a power transistor, and the second terminal of the recording element and the second terminal of the driving element are mutually connected for every pair of the recording element and the driving element. Further, the power source wiring also is provided for every segment, and it is preferable that the GND wiring connected to the first wiring of the segment through a through hole is formed in the second wiring layer for every segment.

Further, in the semiconductor device of the present invention, a first bonding pad connected to each power source wiring and a second bonding pad connected to the GND wiring are provided on the semiconductor substrate, and it is preferable that a wiring width of the power source wiring and the GND wiring is selected for every segment so that a wiring resistance reaching the second bonding pad from the first bonding pad through the power source wiring, a pair of recording element and driving element and the GND wiring is equalized without depending on the segment.

In the semiconductor device of the present invention, it is preferable that the arbitrary number of pairs of recording element and driving element constitutes a block, and the recording element is time-division driven for every block. In this case, each segment may constitute a block, respectively.

The liquid ejection head of the present invention is characterized by comprising the above described semiconductor device and a member for forming the ejection orifice integral with a liquid path and one end of the liquid path associated with the recording element combined into the semiconductor device.

The liquid ejection apparatus of the present invention is characterized by comprising the liquid ejection head of the present invention and means for relatively conveying the print medium to the liquid ejection head.

Other features and advantages of the present invention will be apparent from the following description taken in conjunction with the accompanying drawings, in which like reference characters designate the same or similar parts throughout the figures thereof.

The accompanying drawings, which are incorporated in and constitute a part of the specification, illustrate embodiments of the invention and, together with the description, serve to explain the principles of the invention.

DESCRIPTION OF THE PREFERRED EMBODIMENTS (First Embodiment)

Next, preferred embodiments of the present invention will be described with reference to the drawings. As described below, a liquid ejection head is an ink jet recording head used for an ink jet recording, and the case where a heater for generating heat by the current is used as a recording element will be described. In the present invention, where a number of heaters are arranged on a semiconductor substrate, and further, a drive logic circuit for driving these heaters according to a signal inputted from the outside and power transistors are also arranged on the semiconductor substrate, a number of heaters are divided into several segments in order to reduce the influence arising from the difference of a wiring resistance on the semiconductor substrate. Each segment includes a plurality of heaters and power transistors corresponding to these heaters one for one base.

First, to understand the present invention at full length, a wiring resistance arising from an arrangement of the segment will be described.

Figure 1:
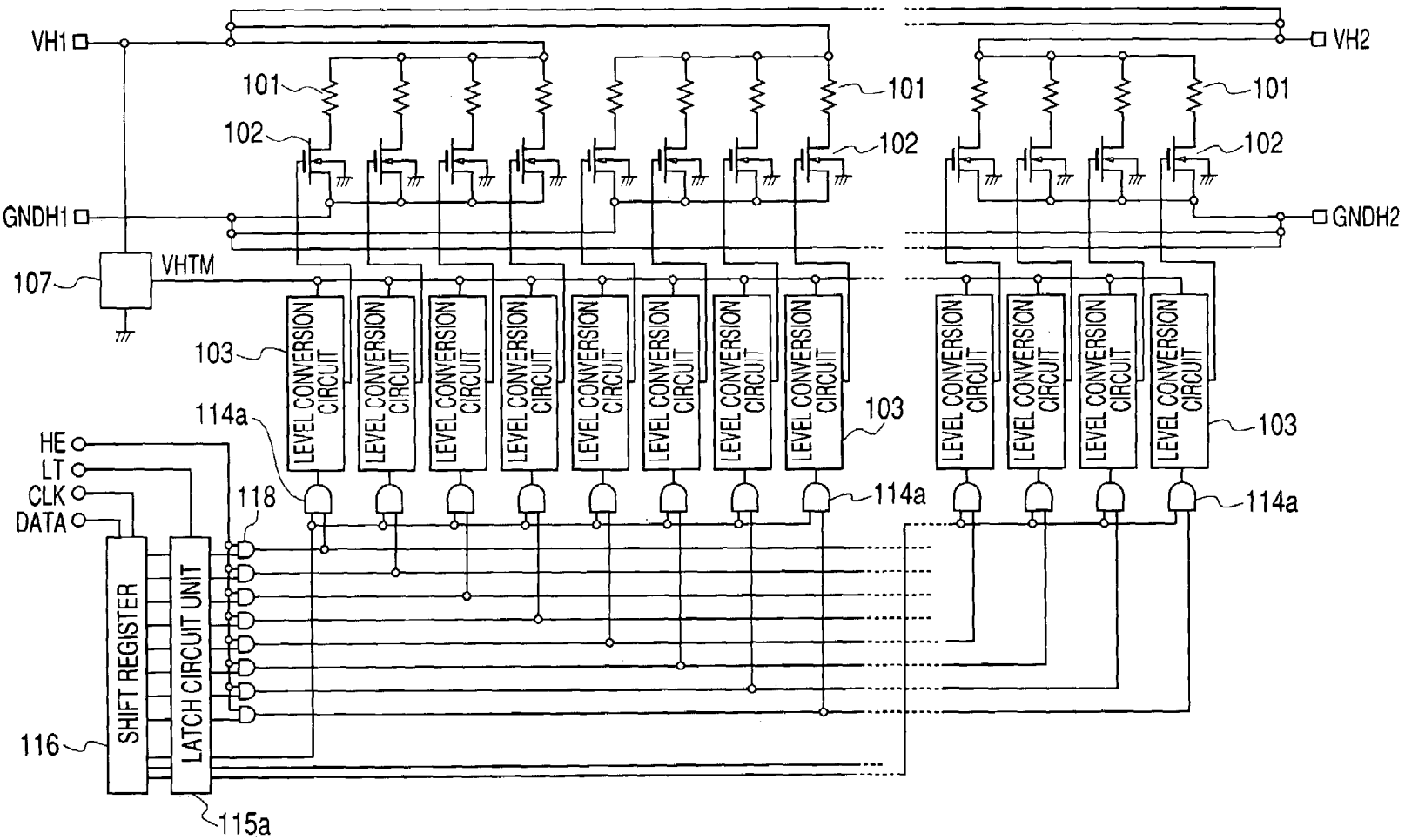
FIG. 1 is a circuit diagram showing a drive circuit of a recording head based on one embodiment of the present invention using a time-division drive system.

FIG. 1 is a view showing a circuit structure of a recording head based on one embodiment of the present invention, which is mounted on a recording apparatus of an ink jet system. The circuit structure shown here shows a drive circuit of a time-division drive system (block drive system) suitable for the miniaturization of the recording head and a high speed operation, and all of illustrated heaters, power transistors, and a drive logic circuit unit are built into the same semiconductor substrate by using a multi-layer wiring technology.

In the circuit structure, there are provided a number of heaters 101 which generate heat for ejecting ink, and to which n type power transistors 102 for supplying a desired current for every heater 101 are connected. Here, from among pairs of heater 101 and power transistor 102, adjacent four pairs make one segment. A power source wiring (VH wiring) and a GND wiring (GNDH wiring) for the heater 101 are individually connected on the semiconductor substrate up to the vicinity of a bonding pad for every segment, respectively, and in the vicinity of the bonding pad unit, the power source wirings and the GND wirings of all the segments are brought together and connected to the bonding pads.

For example, when six pieces of the segment are arranged (that is, when 24 pieces of heater are provided), here, the VH wiring and the GND wiring are divided into three segments of the left side and three segments of the right side, respectively, and the three segments of the left side are connected to the bonding pads VH1 and GNDH1 provided in the left end portion of the semiconductor substrate, and the three segments of the right side are connected to bonding pads VH2 and GNDH2 provided in the right end portion of the semiconductor substrate, thereby reducing the wiring resistance. Furthermore, a wiring width for the segment which is close from the bonding pad unit is made thin, and a wiring width for the segment which is far from the bonding pad unit is made thick so that a parasitic resistance of the wiring to each segment becomes equal. Further, a contrivance is exercised such that if the VH wiring is connected from the illustrated right end of the segment in each segment so that the difference of the wiring resistance value in each heater within the segment becomes small, the GNDH wiring is allowed to be connected from the illustrated left end of the segment, and on the contrary, if the VH wiring is connected from the illustrated left end of the segment, the GNDH wiring is allowed to be connected from the illustrated right end of the segment. Since both the VH wiring and the GNDH wiring are formed by a standard manufacturing method for manufacturing a semiconductor device having a multi layer wiring construction, for example, a standard process for manufacturing a large scale integrated circuit (LSI), the thickness of its wiring layer is uniform.

Figure 2:
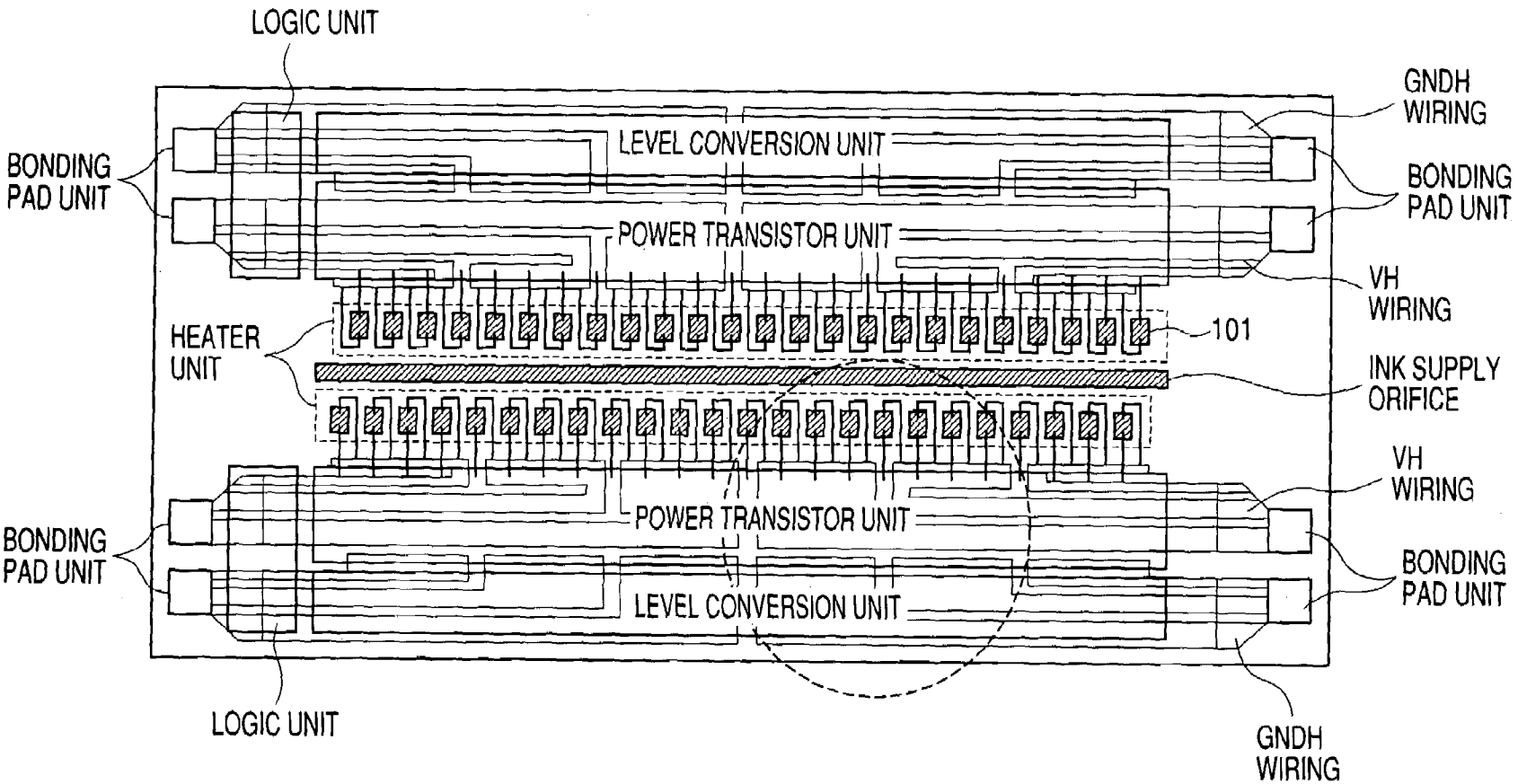
FIG. 2 is a view showing a layout of the whole of the circuit arrangement on a substrate in the recording head shown in FIG. 1.

Illustrating the pulling around of the VH wiring and the GNDH wiring described here is FIG. 2. In FIG. 2 is shown a structure mounting recording head drive circuits on both sides for an ink supply orifice. This recording head, similarly to the conventional technology, is formed on a silicon semiconductor substrate by using the semiconductor device manufacturing technology, particularly by using the multi layer wiring technology. The VH wiring is provided so as to pass through above the power transistor unit (forming region of the power transistors 102) by using an aluminum wiring of the second layer. The GNDH wiring is also provided so as to pass through above a level conversion unit (forming region of the level conversion circuit) by using an aluminum wiring of the second layer.

Figure 13:
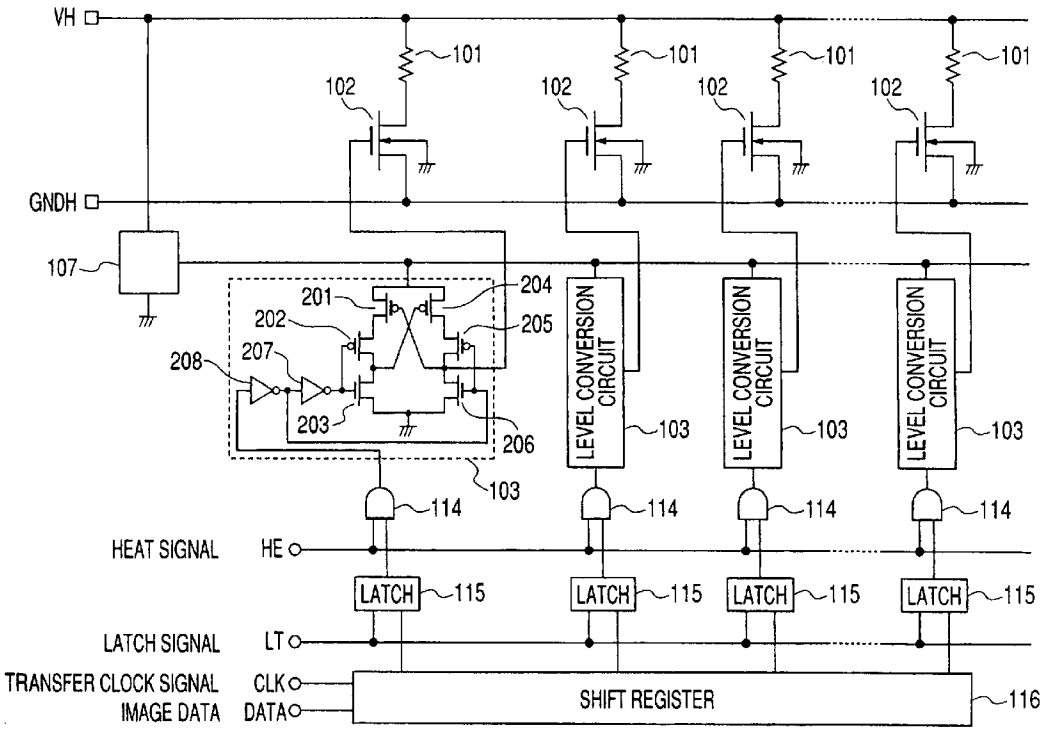
PRIOR ART FIG. 13
FIG. 13 is a circuit diagram showing one example of the structure of the conventional recording head drive circuit.
Figure 14:
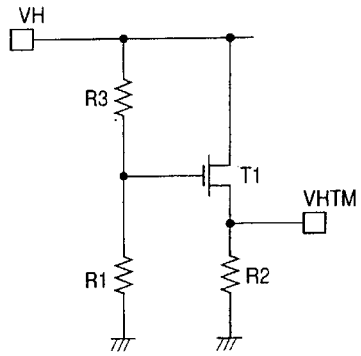
FIG. 14 is a circuit diagram showing one example of the structure of a voltage generating circuit.
Figure 15:
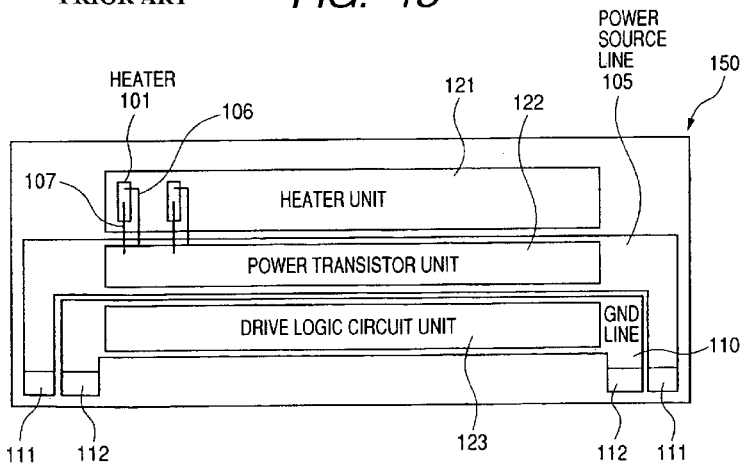
PRIOR ART FIG. 15
FIG. 15 is a view showing the layout of a power source wiring in the conventional recording head shown in FIG. 13.

Continuing to describe FIG. 1, the level conversion circuit 103 is provided for each power transistor 102, and the output of the level conversion circuit 103 is supplied to the gate of the corresponding power transistor 102. A voltage generating circuit 117 is provided in order to supply a power source voltage VHTM to each level conversion circuit 103 through an inner power source line. An AND circuit (first AND circuit) 114*a* is provided for every level conversion circuit 103, and the output of the first AND circuit 114*a* is inputted to the corresponding level conversion circuit 103. The structure of the level conversion circuit 103 and the structure of the voltage generating circuit 117 are the same as the conventional circuit structures shown in FIGS. 13 and 14, and here, the circuit structure thereof will not be specifically described.

To realize a time-division drive, there is provided a latch circuit unit 115*a*, and in the example shown here, there exist 11 pieces of latch circuit within the latch circuit unit 115*a*. In the latch circuit unit 115*a*, there is provided an input terminal for inputting a latch signal LT. Further, there is provided a shift register circuit 116 having 11 stages, and 11 pieces of output terminal of the shift register circuit 116 are connected to 11 pieces of latch circuit on a one for one base within the latch circuit unit 115*a* following to the circuit of the next stage. Further, in the shift register circuit 116, there are provided a transfer clock signal CLK and an image data signal input terminal for inputting in serial image data DATA for turning the heater 1010N and OFF. Here, one block for the time-division drive is constituted by adjacent eight pieces of heater 101, and since the illustrated block has 24 pieces of heater 101, three blocks are provided. Within each block, the heater 101 is time-division driven.

Preceding three bits of the output from the latch circuit unit 115*a* are for selecting a block. One bit out of these three bits is supplied to a first input terminal (terminal of the illustrated left side) of the first AND circuit 114*a* for every heater 101 of the illustrated left side block. One bit of the remaining two bits out of these three bits is similarly supplied to the first input terminal of the first AND circuit 114*a* of the second block, and the last one bit is supplied to the first input terminal of the first AND circuit 114*a* of the third block (block of illustrated right end).

The remaining eight bits subsequent to the preceding three bits denote which heater should be selected from among eight pieces of heater within the block. From among the outputs of the latch circuit unit 115*a*, these eight bit portions are provided with a second AND circuit 118, respectively and are inputted with a signal from the latch circuit unit 115*a*. The other input terminal of the second AND circuit 118 is inputted with a heater signal HE for deciding a heater ON time. The output of the number one second AND circuit 118 is connected to the second input terminal of the first AND circuit 114*a* corresponding to the first heater of each block, and similarly, the output of the nth number (2<n<8) second AND circuit 118 is connected to the second input terminal of the first AND circuit 114*a* corresponding to the nth heater of each block. Here, with respect to the output of second AND circuit 118 of eight pieces, two pieces or more are not allowed to become "1" at the same time.

Figure 3:
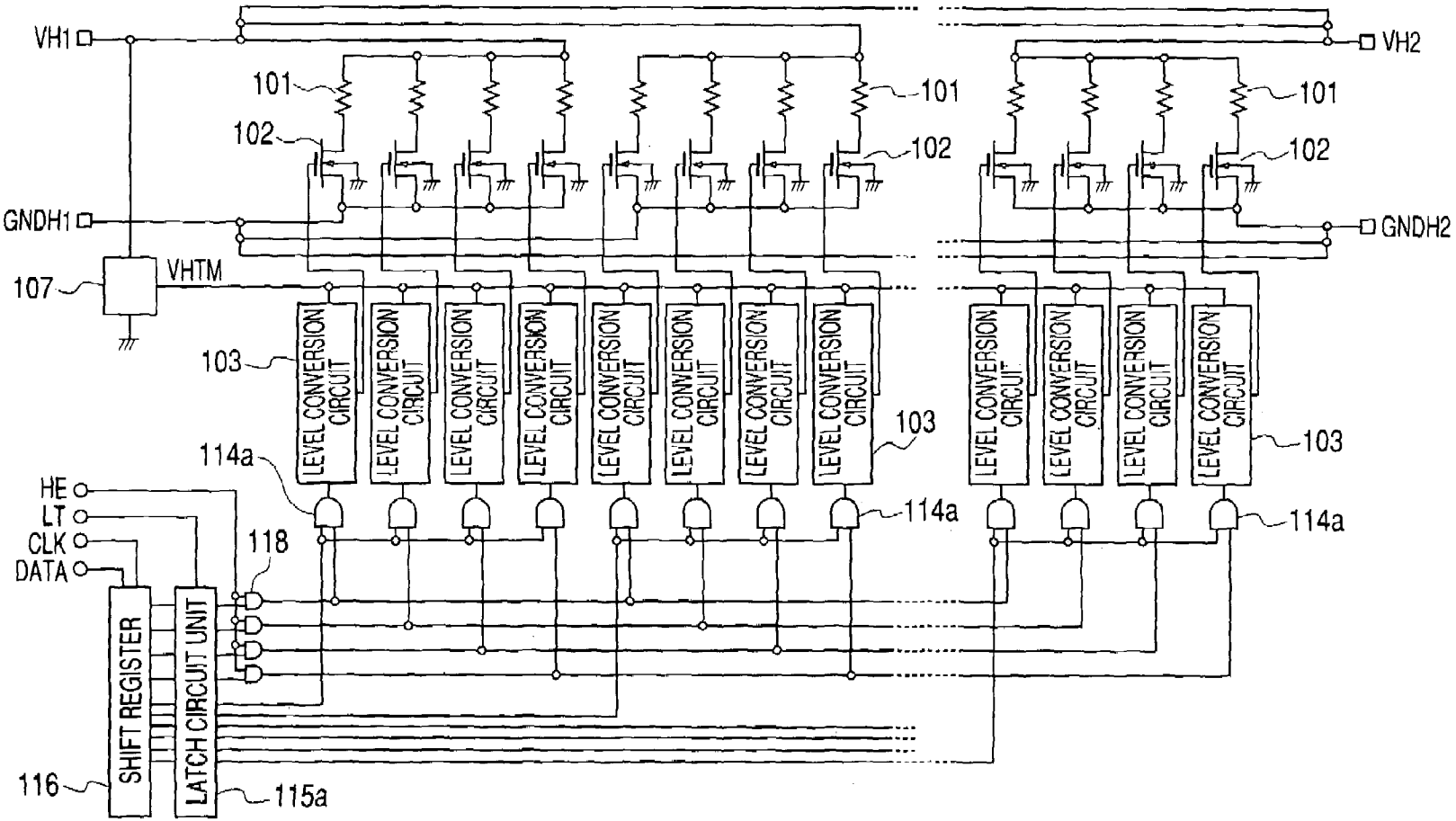
FIG. 3 is a circuit diagram showing another example of the drive circuit of the recording head.

Although, by using this structure, the number of heaters capable of being put into an ON state at the same time is available by the number of blocks, since the heater is time-division driven within the block for every block, even if the number of heaters is increased, a high speed operation is possible. Here, with respect to the VH wiring and the GNDH wiring, the segment is constituted by four pieces of heater, and at the same time, the block which becomes a unit of the time-division drive is constituted by eight pieces of heater, but the number of heaters which constitute the segment and the number of heaters which constitute the block are not limited to these numbers, nor limited to the above described relationship between both of the segment and the block. For example, the same heaters may constitute the segment and the block. For example, FIG. 3 shows a circuit structure wherein four pieces of heater constitute one segment, and at the same time, this one segment as it is constitutes one block on the time-division drive. In this case, since six bits are required to select the block and four bits are required to select the heater within the block, a shift register having ten stages is used, and further, the second AND circuit 118 is provided in four pieces. Alternatively, even when one block is constituted by a plurality of segments, in addition to the case where the above described one block is constituted by two segments, one block may be constituted by three segments or more.

Figure 4:
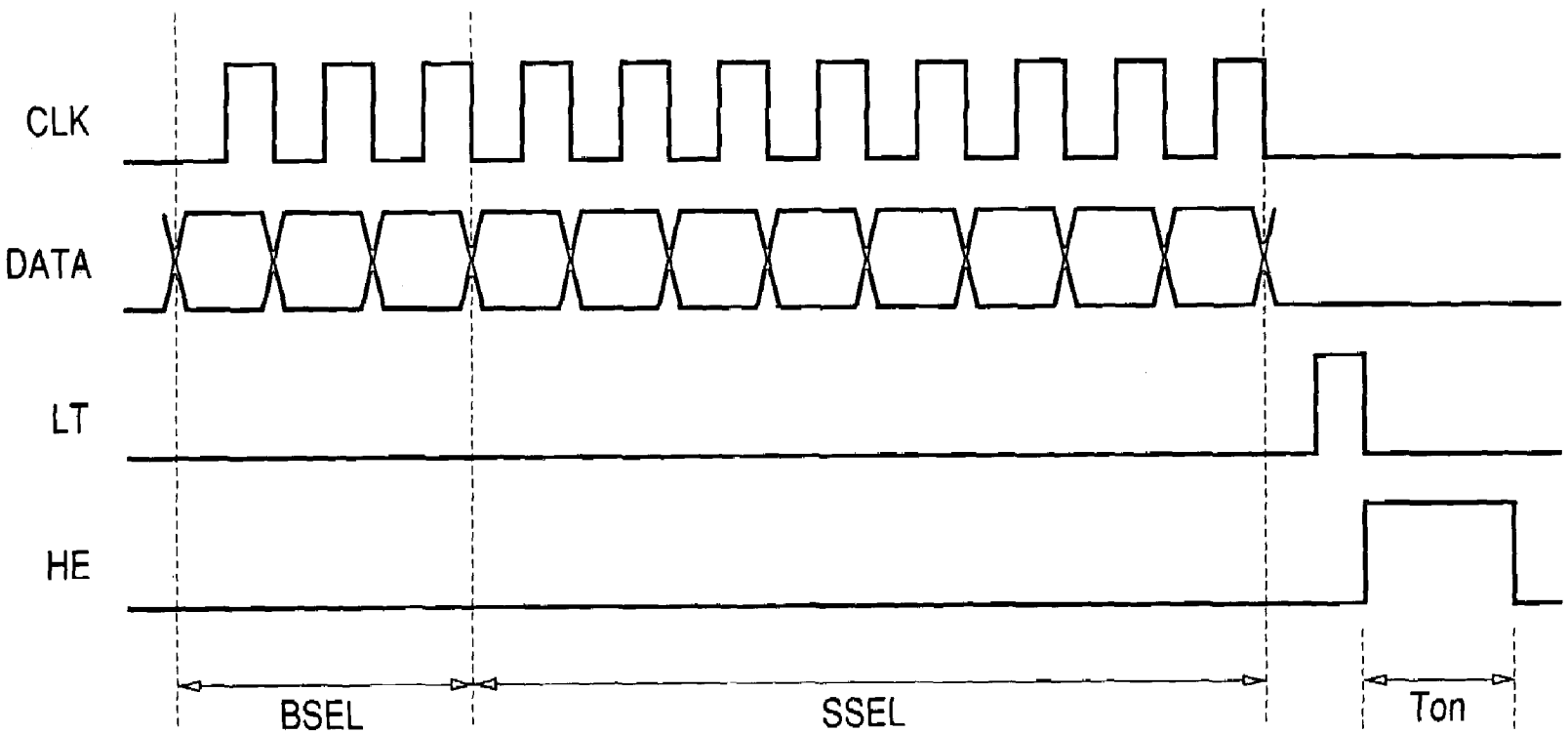
FIG. 4 is a timing chart showing a control signal when using the time-division drive system.

FIG. 4 is a timing chart showing the relationship of various signals for driving the drive circuit of the recording head shown in FIG. 1.

The recording head of the present embodiment is different from the circuit structure of the conventional recording head, and as described above, one block is constituted by eight pieces of heater, and therefore, in the drive timing chart, the first half three clock portion (BSEL) of the image data signal DATA and the last half eight clock portion (SSEL) are different in its meaning shown by the data. The data given to the first half three clocks (BSEL) is a data to select which block of the heater unit should be driven, and the last half eight clocks (SSEL) is a data to select which heater within the block should be driven. When all the data are written within the shift register 116 by the transfer clock signal CLK, the value thereof is decided by the latch signal LT, and is outputted to each circuit of the next stage.

When the drive circuit shown in FIG. 1 is driven by using the timing chart shown in FIG. 4, an output BSEL of the latch circuit 115*a* is inputted to all the first AND circuits 114*a* within the block, and an output SSEL of the latch circuit unit 115*a* is inputted to the first AND circuit 114*a* corresponding to each heater constituting the block through the second AND circuit 118. That is, in the second AND circuit 118, the output SSEL of the latch circuit 115*a* and the heat signal HE are logic-processed, and its output is logic-processed with the output BSEL of the latch circuit unit 115*a* in the first AND circuit 114*a*, thereby allowing a desired heater to be driven.

The layout on the substrate of the recording head having the circuit structure shown in FIG. 1, as described above, becomes, for example, as shown in FIG. 2. On the side of the short side of the recording head substrate, there is provided a bonding pad for supplying the power, and from there, the VH wiring and the GNDH wiring are connected to each segment of the heater unit. The logic circuit unit such as shift register circuit 116 shown in FIG. 1, the latch circuit unit 115*a* and the like, for example, as shown in FIG. 2, is provided between a power transistor unit and a bonding pad unit. Since the level conversion circuit 103 is provided for every heater 101, the forming region of the level conversion circuits 103 (level conversion circuit unit) is provided so as to be alongside the power transistor unit.

Figure 5:
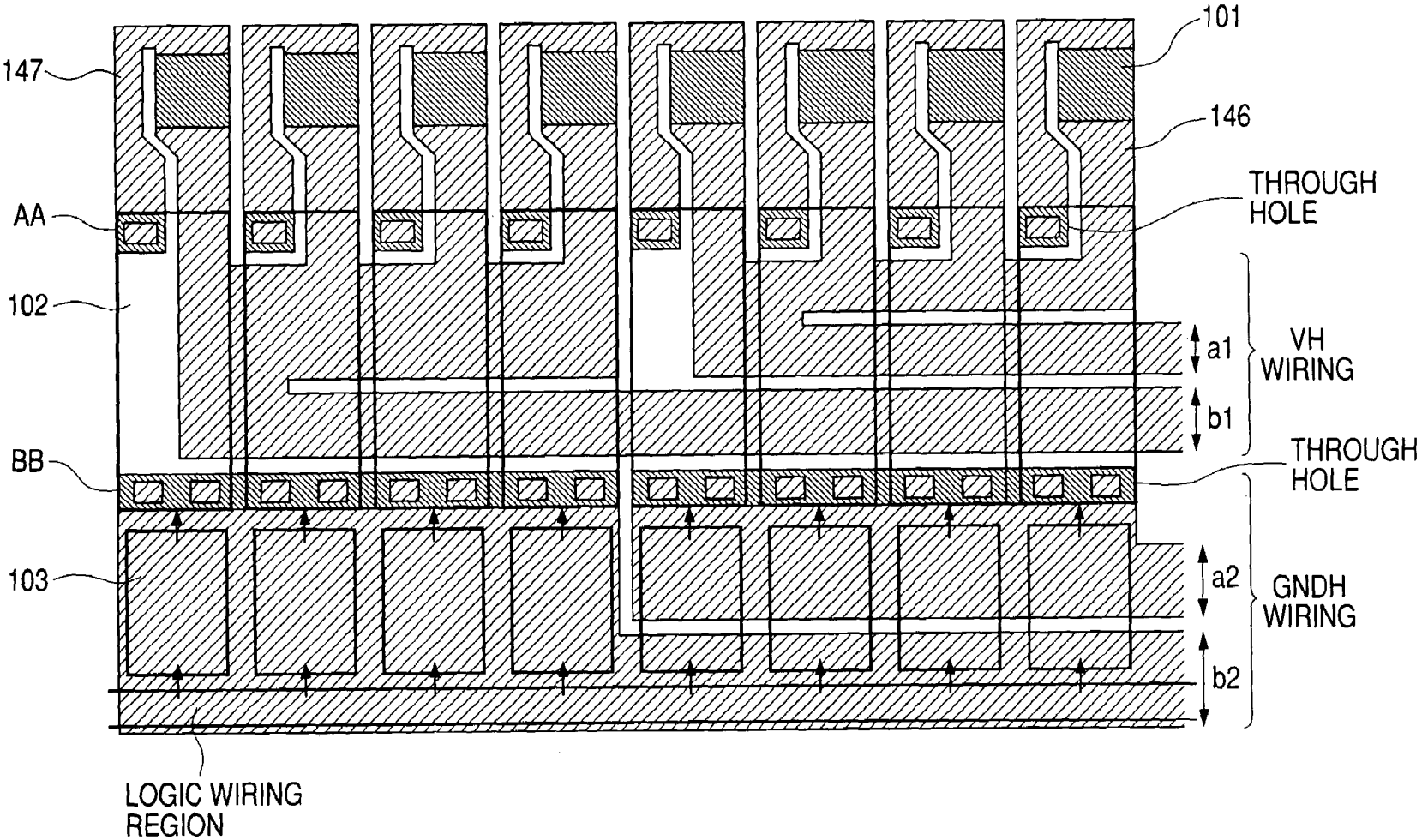
FIG. 5 is an enlarged view showing the layout of a heater, a power transistor and each wiring for each segment.

FIG. 5 is an enlarged view of a portion surrounded by a dotted line in FIG. 2, wherein an arrangement structure of the heater 101, the power transistor 102 and the level conversion circuit 103 as well as a power source wiring layout are described in detail. However, while the present invention is characterized by having an auxiliary wiring, FIG. 5 shows a structure having no auxiliary wiring so as to be able to describe the effect of the present invention. In FIG. 5, a shaded portion shows a wiring pattern in an aluminum wiring layer AL 2 of the second layer, and a dark gray portion shows a wiring pattern in an aluminum wiring layer AL1 of the first layer. As described earlier, the thickness of the wiring to each segment is different so that the resistance value from the bonding pad unit to the segment becomes equal. That is, where the wiring width of the VH wiring and the GNDH wiring for the segment close to the bonding pad unit is taken as a1 and a2, respectively, and the wiring width of the VH wiring and the GNDH wiring for the segment far from the bonding pad unit is taken as b1 and b2, respectively, the relationship of b1>a1 and b2>a2 is established. With respect to each heater within the segment, a layout having a return structure is set up so that the difference of the resistance value between the VH wiring and the GNDH wiring is made small and the VH wiring is connected to the position corresponding to the heater of the left end of the segment. The GNDH wiring is laid out so as to be connected to the position corresponding to the heater of the right end of the segment.

In FIG. 5, reference character AA denotes an output end (drain terminal) of the power transistor 102, which is constituted by the wiring layer AL1 of the first layer. In this position of the AA, there is also formed a through hole, and at this position, the output end of the power transistor 102 is pulled out also to the wiring layer AL2 of the second layer and connected to the heater 101 by a wiring 147 formed by patterning the wiring layer AL2 of the second layer. Further, the heater 101 and the VH wiring constituted as the wiring layer AL2 of the second layer are connected by a wiring 146 formed by patterning the wiring layer AL2 of the second layer.

In FIG. 5, reference character BB denotes a connection unit to the GNDH wiring of the power transistor, wherein the wiring layer AL1 of the first layer is subjected to a patterning, and connects all sources of the power transistors 102 within the segment. In the recording head, a pitch between the heaters 101 is decided by a resolution of the recording head, and so long as the heater and the power transistor are provided one for one base, the space useable for arranging the power transistor is also limited by the resolution. To be more specific, for example, in the recording head having a resolution of 600 dpi (600 dots per 25.4 mm), the layout pitch (width) of the heater is 42.5 μm, and within this width, the power transistor, the level conversion circuit and the like for every heater have to be laid out. Since the power transistor has a relatively large floor area, to effectively perform the layout, it is preferable to superpose source regions of adjacent power transistors, and by so doing, it is possible to effectively use a wider width than the layout width of 600 dpi. Consequently, the wiring pattern of the first layer by reference character BB is provided so as to connect all sources of the power transistors within the same segment. Further, in the position of reference character BB, there is provided a through hole, and the source of the power transistor 102 is pulled out up to the wiring layer AL2 of the second layer, and by the GNDH wiring formed on the wiring layer AL2 of the second layer, the source of each power transistor is connected to the bonding pad.

By adopting the structure as described above, the problem that the wiring resistance between the VH wiring and the GNDH wiring becomes different depending on the location of the heater can be solved, so that the recording head capable of realizing a high speed operation can be provided.

Making a research work further on the above described structure, it is evident from FIG. 5 that, at the VH wiring side, the heaters within the segment are connected by the wiring layer AL2 of the second layer, while at the GNDH wiring side, the layout is made not only by using the wiring layer AL2 of the second layer, but also by using the wiring layer AL1 of the first layer. Consequently, the difference of the resistance value between the VH wiring and the GNDH wiring for each heater within the same segment becomes large. This difference of the resistance value becomes much larger when the number of heaters constituting one segment becomes high, and moreover, the specific resistance of the wiring layer AL2 of the second layer is larger compared to the specific resistance of the wiring layer AL1 of the first layer. This will be described with reference to FIG. 6.

Figure 6:
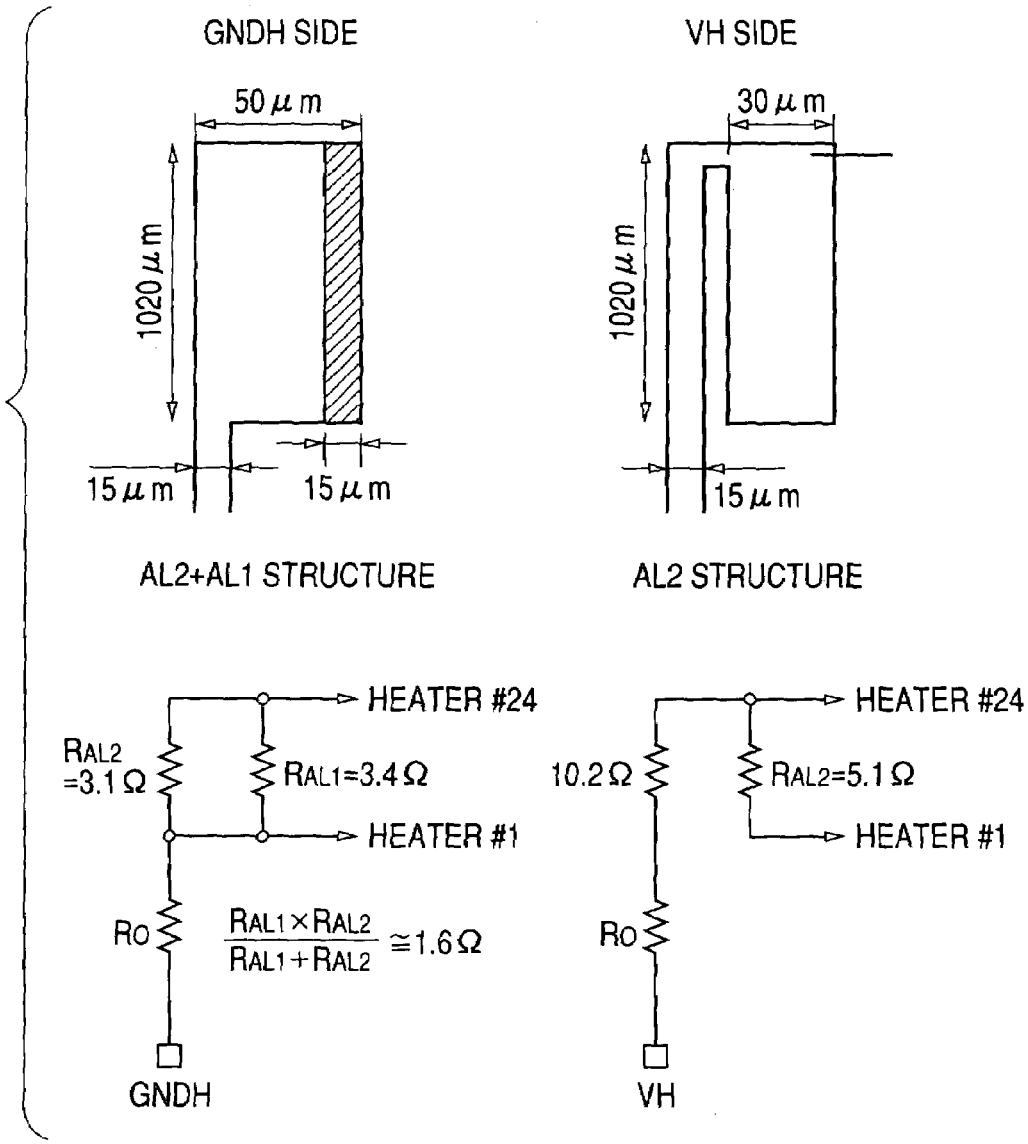
FIG. 6 is a view explaining about an irregularity of an equivalent circuit and a wiring resistance in the wiring layout shown in FIG. 5.

FIG. 6 shows a layout image of the GNDH wiring and the VH wiring within the segment and an equivalent circuit of a parasitic resistance (wiring resistance) in the case where one segment is constituted by 24 pieces of heater. This equivalent circuit is calculated by taking a sheet resistance $\rho_{AL1}$ of the aluminum wiring layer AL1 of the first layer as $\rho_{AL1}$=0.05Ω/□, and a sheet resistance $\rho_{AL2}$ of the aluminum wiring layer AL2 of the second layer as $\rho_{AL2}$=0.15Ω/□. With respect to the sheet resistance value used here, the reason why the value of the second layer is higher than the value of the first layer is because, while in case of the recording head to eject an ink by using heat energy, since a nozzle unit constituting an ink flow path and a liquid chamber is constituted on the recording head, the film thickness of the wiring layer AL2 of the second layer has a tendency to become thinner than the film thickness of the wiring layer AL1 of the first layer in consideration of the step on the surface of the recording head after wiring process. The wiring resistance value at this time from the pads in the first heater #1 and 24th heater #24 is as shown in the following table 1. A resistance Ro is a wiring resistance of the VH wiring and the GNDH wiring from the bonding pad to its segment.

TABLE 1

| | GNDH wiring resistance [Ω] | VH wiring resistance [Ω] | (GDNH + VH) wiring resistance [Ω] |
|---|---|---|---|
| Heater #24 | Ro + 1.6 | Ro + 10.2 | 2Ro + 11.8 |

TABLE 1-continued

| | GNDH wiring resistance [Ω] | VH wiring resistance [Ω] | (GDNH + VH) wiring resistance [Ω] |
|---|---|---|---|
| Heater #1 | Ro | Ro + 10.2 + 5.1 | 2Ro + 15.3 |

From Table 1, a difference ΔR of the wiring resistance between the heater #24 and the heater #1 (GNDH+VH) becomes 3.5Ω.

As a method for further reducing this difference ΔR of the wiring resistance, there is a method conceivable where a power source wiring width of the wiring layer AL2 of the second layer at the VH wiring side is widened and the resistance value is matched. However, such a method cannot be realized sometimes because of the limitation of the substrate size of the recording head.

Further, as another reducing method, there is a method conceivable where the wiring width of the wiring layer AL2 of the second layer at the GNDH wiring side is made small, and is matched to the resistance value of the VH wiring side. However, since the resistance of the GNDH wiring is made high, a source potential of the power transistor is raised, and the resistance value at the ON time of the power transistor is made high. This means ineffective power consumption other than energy for ejecting the ink, and is unable to be simply executed in view of an energy saving.

As a method for reducing the difference ΔR of the wiring resistance other than the above described method, there is a method conceivable where the wiring resistance value of the VH wiring side is matched to the resistance value of the GNDH wiring side at a location other than the wiring layer AL2 of the second layer. Its layout is shown in FIG. 7.

Figure 7:
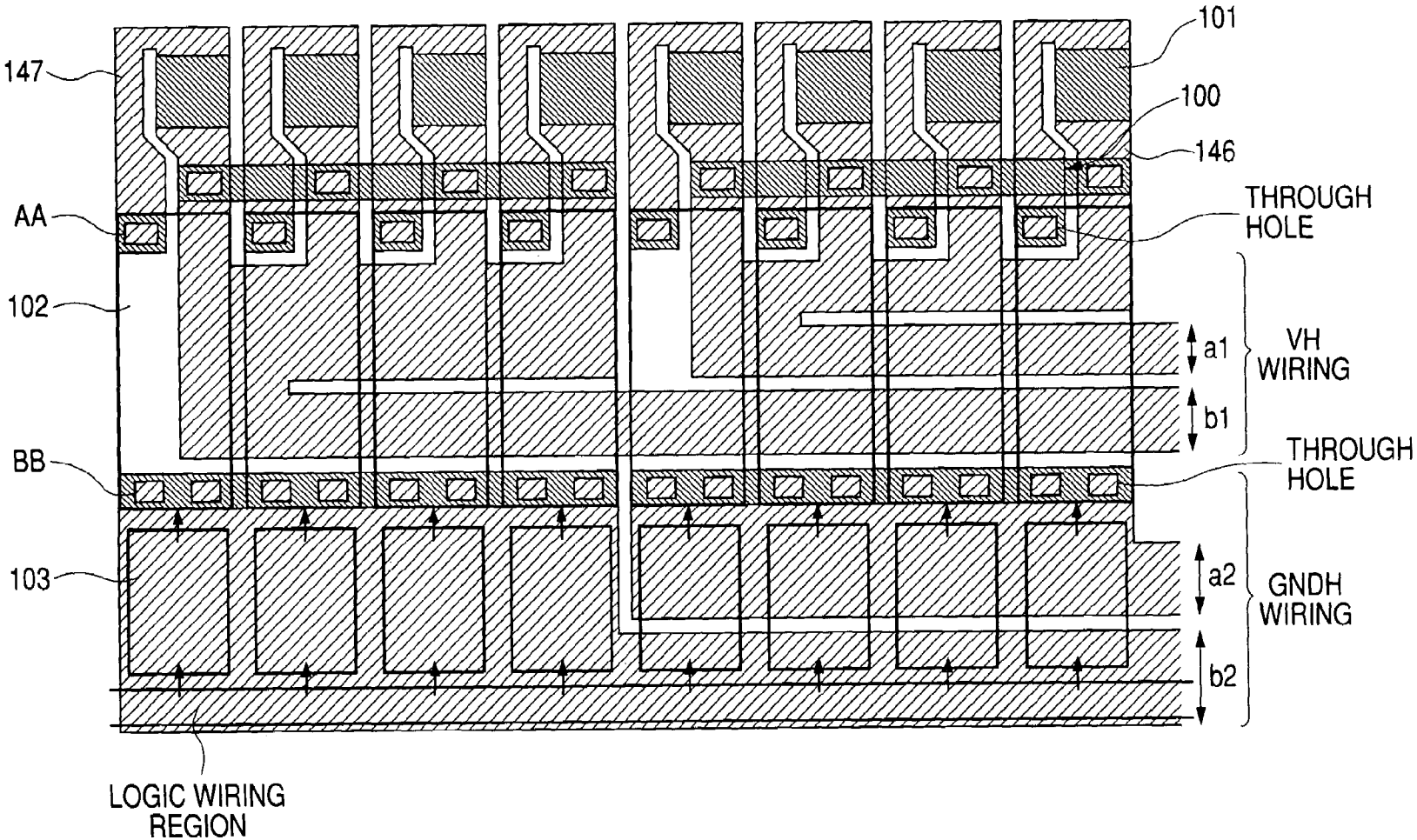
FIG. 7 is an enlarged view showing the layout of the heater, the power transistor and each wiring for each segment based on one embodiment of the present invention.

The structure shown in FIG. 7 is different from the structure shown in FIG. 5 in that an auxiliary wiring 100 is further provided. The auxiliary wiring 100 is provided for each segment at a location interposed between the layout region of the heater 101 and the output end position (position of reference character AA) of the power transistor 102. The auxiliary wiring 100 is formed on the wiring layer other than the wiring layer AL2 of the second layer in a multi layer wiring, and mutually electrically connects the end portion of the VH wiring side of each heater within the segment through a through hole. This auxiliary wiring 100 is a wiring to match the wiring resistance value of the VH wiring side to the resistance value of the GDNH wiring side. Here, it is preferable that the wiring layer constituting the auxiliary wiring 100 is the wiring layer AL1 of the first layer that is a wiring layer in which a part of the GNDH wiring side wiring is formed. Further, it is desirable that the wiring width of the auxiliary wiring 100 is equal to the width of a portion which connects the source of the power transistor in the wiring layer AL1 of the first layer.

Figure 8:
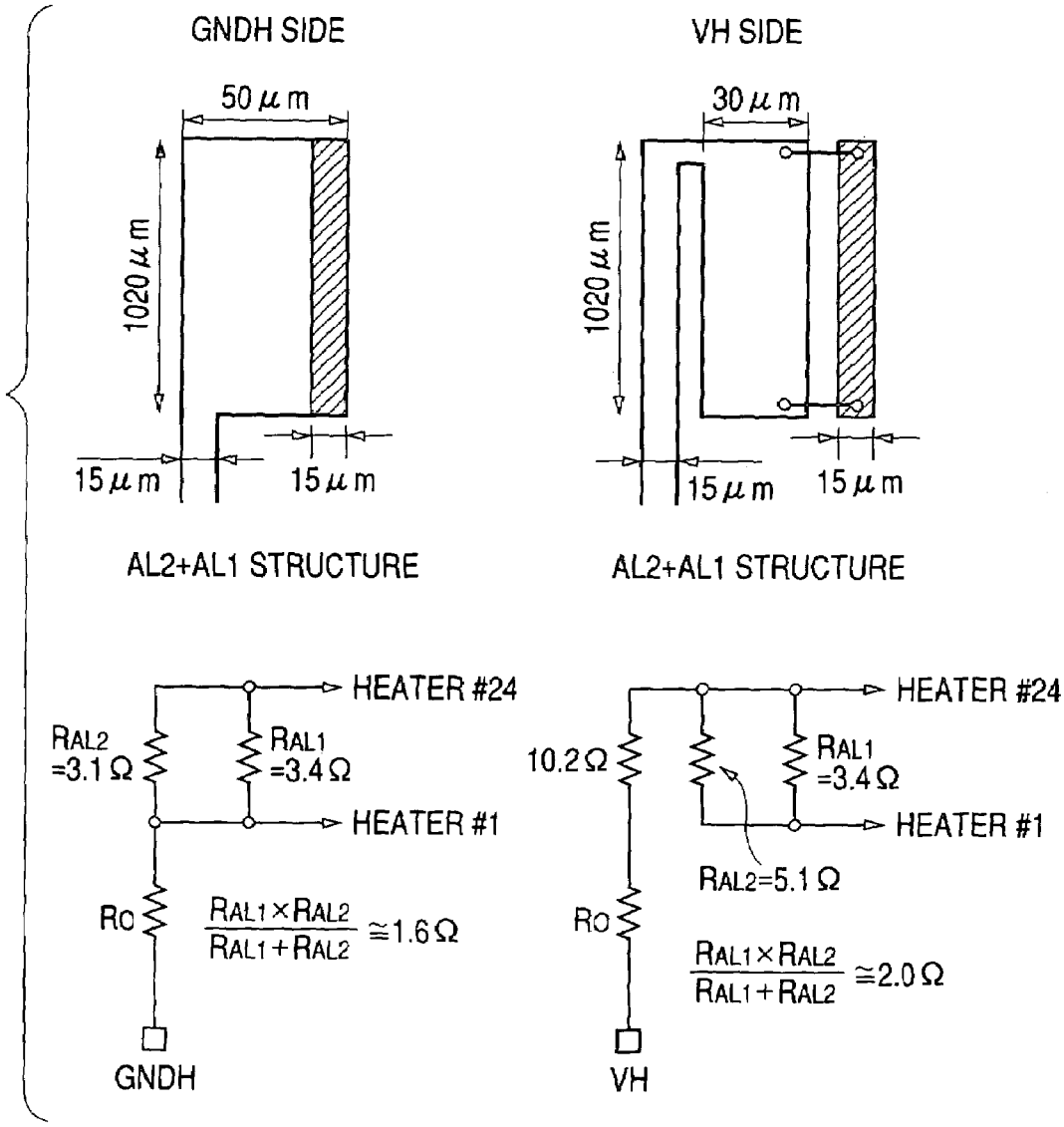
FIG. 8 is a view explaining about the irregularity of the equivalent circuit and the wiring resistance in the wiring layout shown in FIG. 7.

FIG. 8 shows the layout image of the GNDH wiring and the VH wiring within the segment and the equivalent circuit of the parasitic resistance (wiring resistance) in case of providing the auxiliary wiring 100 as shown in FIG. 7. In FIG. 8, similarly to the segment shown in FIG. 6, one segment is constituted by 24 pieces of heater, and when the equivalent circuit is calculated, the sheet resistance $\rho_{AL1}$ of the wiring layer AL1 of the firs layer is taken as $\rho_{AL1}$=0.05Ω/□, and the sheet resistance $\rho_{AL2}$ of the aluminum wiring layer AL2 of the second layer is taken as $\rho_{AL2}$=0.15Ω/□. The wiring resistance value at this time from the pads in the first heater #1 and the 24th heater #24 is as shown in the following table 2.

TABLE 2

| | GNDH wiring resistance [Ω] | VH wiring resistance [Ω] | (GDNH + VH) wiring resistance [Ω] |
|---|---|---|---|
| Heater #24 | Ro + 1.6 | Ro + 10.2 | 2Ro + 11.8 |
| Heater #1 | Ro | Ro + 10.2 + 2.0 | 2Ro + 12.2 |

As evident from Table 2, by providing the auxiliary wiring 100, it is possible to reduce the difference ΔR of the wiring resistance between the heater #24 and the heater #1 up to 0.4Ω. Naturally, if there is an allowance in the space possible to lay out, the width of a resistance dowelling auxiliary wiring 100 may be widened, thereby allowing the difference ΔR of the wiring resistance between the heater #24 and the heater #1 to further approach zero.

As described above, in the present embodiment, as shown in FIG. 7, by providing the resistance dowelling auxiliary wiring 100, the wiring resistance values within the segment can be effectively matched without making a substrate size of the recording head remarkably large. Further, even when there is a change of the film thickness of the wiring layer in the wiring layers AL1 or AL2, there is such a feature also available that the irregularity of the wiring resistance value within the segment is hard to be affected by the change of the film thickness.

(Second Embodiment)

Figure 16:
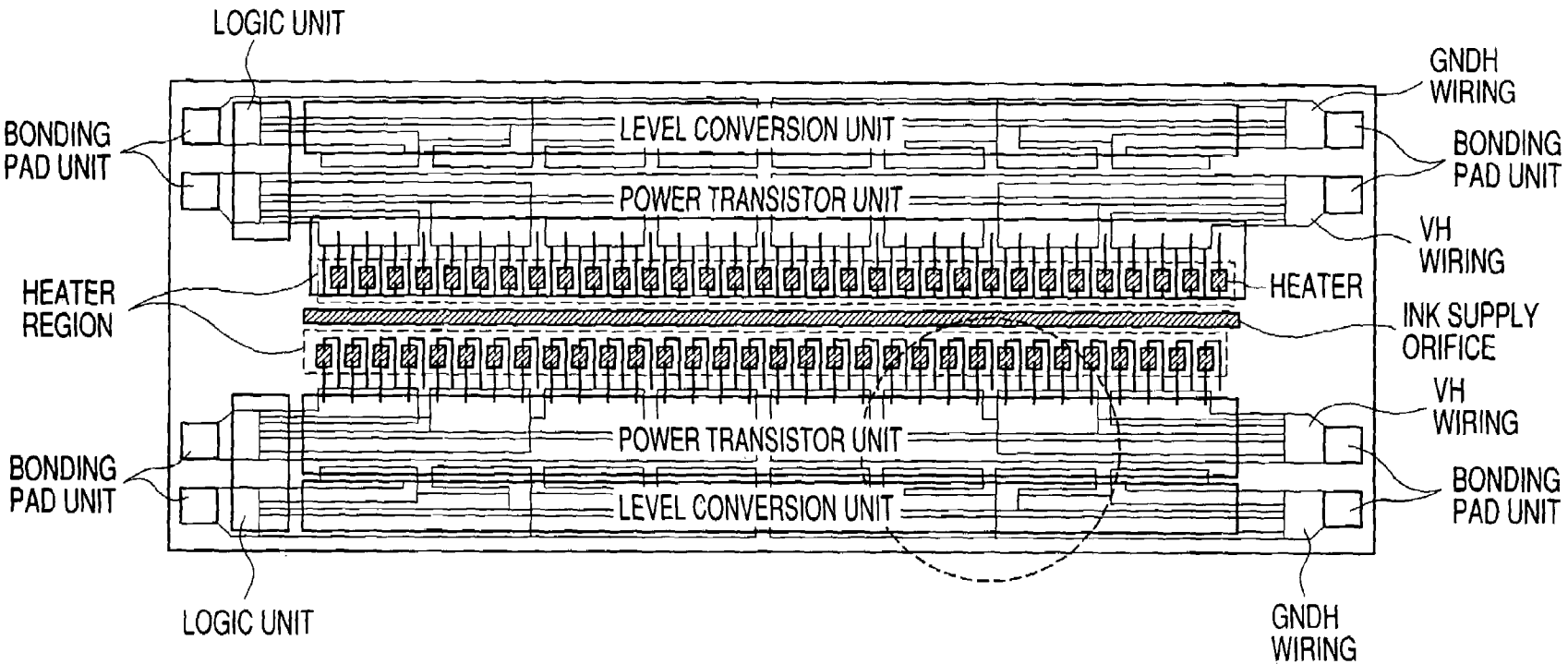
FIG. 16 is a view showing a VH wiring and a GND wiring of a second embodiment.

The present embodiment is characterized by having three wiring layers. The description of the like structure as the first embodiment will be omitted. Showing a layout of a VH wiring and a GNDH wiring of the present embodiment is FIG. 16. FIG. 16 shows a structure, which mounts a recording head drive circuit on both sides for an ink supply orifice. The VH wiring is provided so as to pass through above the power transistor unit (forming region of the power transistor 102) by using a second layer aluminum wiring or a third layer aluminum wiring. Further, the GNDH wiring is also provided so as to pass through above a level conversion unit (forming region of the level conversion circuits) by using the second layer aluminum wiring or the third layer aluminum wiring. In the present embodiment, the wiring connected to the heater arranged close to a bonding pad unit is formed by the second layer aluminum wiring, and the wiring connected to the heater far from the bonding pad unit by the third aluminum wiring. By having such a structure, since a film thickness of the third wiring layer (wiring layer of the uppermost) can be set relatively thick so as to have a low resistance, the resistance of the wiring can be aligned without depending on the layout of the segment, and this is further preferable.

A level conversion circuit 103 is provided for every heater 101, and therefore, the forming region (level conversion circuit unit) of the level conversion circuits 103 is provided so as to be alongside the power transistor unit.

Figure 17:
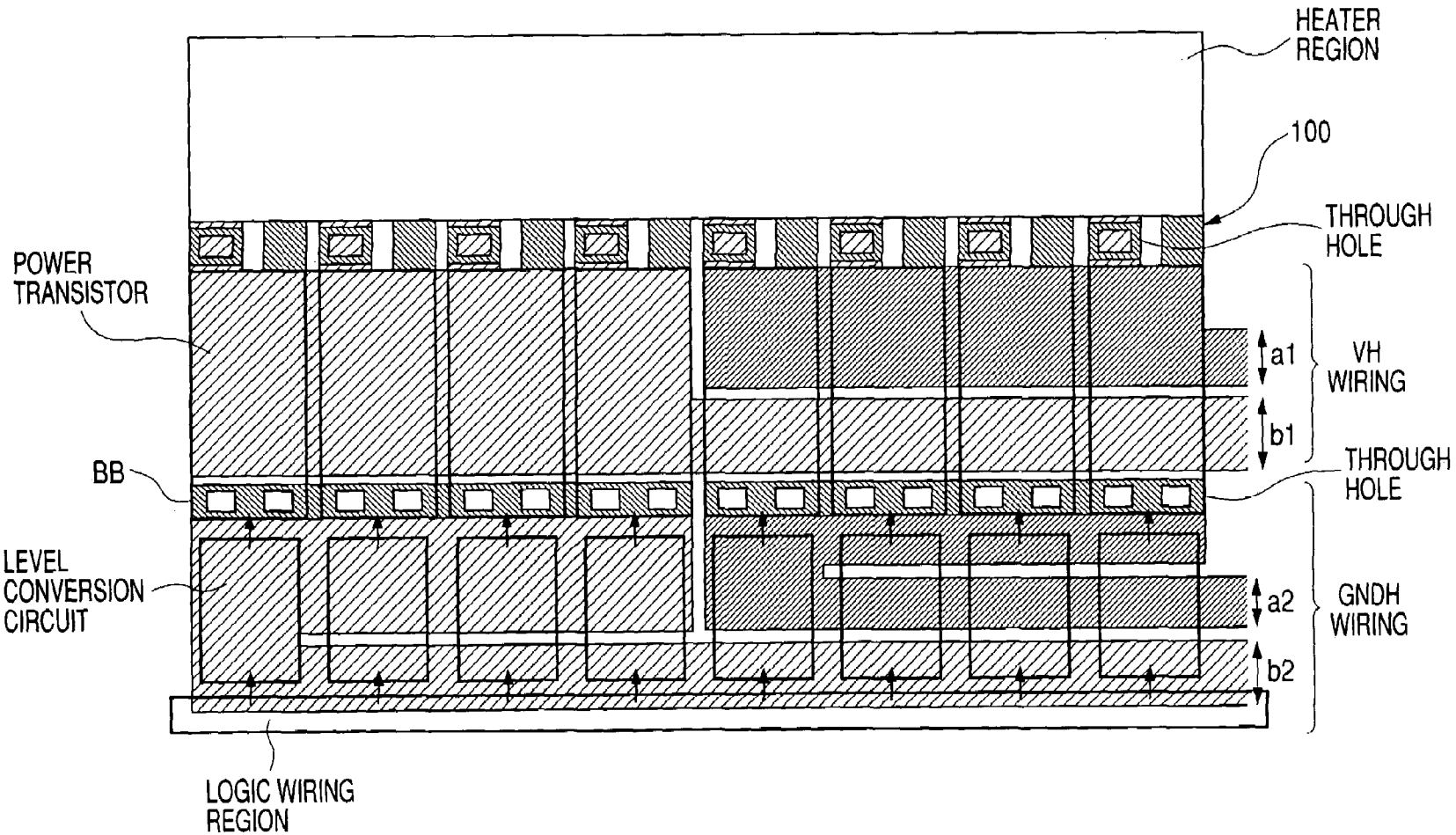
FIG. 17 is an enlarged view of a portion surrounded by a dotted line of FIG. 16.

FIG. 17 is an enlarged view of a portion surrounded by a dotted line in FIG. 16, wherein a layout structure of the heater 101, the power transistor 102 and the level conversion circuit 103 as well as a wiring layout are described more in detail. In FIG. 17, a fine shaded portion shows a wiring pattern at an aluminum wiring layer AL 2 of a second layer, a rough shaded portion shows a wiring pattern at an aluminum wiring layer AL2 of the third layer, and a dark gray portion shows a wiring pattern at an aluminum wiring layer AL1 of the first layer. As described earlier, the thickness of the wiring to each segment is different so that the resistance value from the bonding pad unit to the segment becomes equal. That is, even when the wiring layer is different, the wiring width is decided so as to establish a relationship where the wiring layer has an approximate equivalent resistance value. Further, as described above, it is possible to make the resistance value uniform by the film thickness of the wiring. With respect to each heater within the segment, a layout having a return structure is set up so that the difference of the resistance value between the VH wiring and the GNDH wiring is made small and the VH wiring is connected to the position corresponding to the heater of the left end of the segment. A layout is set up so that the VH wiring is connected to the position corresponding to the right end heater of the segment.

In FIG. 17, reference character BB denotes a connection unit to the GNDH wiring of the power transistor, wherein the wiring layer AL1 of the first layer is subjected to a patterning, and connects all sources of the power transistors 102 within the segment. Further, in the position of reference character BB, there is formed a through hole, and the source of the power transistor 102 is pulled out up to the wiring layer AL2 of the second layer or the wiring layer AL3 of the third layer. By the GNDH wiring formed by the wiring layer AL2 of the second layer or the wiring layer AL3 of the third layer, the source of each power transistor is connected to the bonding pad.

By adopting the structure as described above, the problem that the wiring resistance between the VH wiring and the GNDH wiring becomes different depending on the location of the heater can be solved, and the recording head capable of realizing a high speed operation can be provided.

Making a research work further on the above describe structure, it is possible to provide a suitable liquid ejection semiconductor device similarly to the first embodiment by providing an auxiliary wiring even when the wiring layer is increased to three layers.

Figure 18:
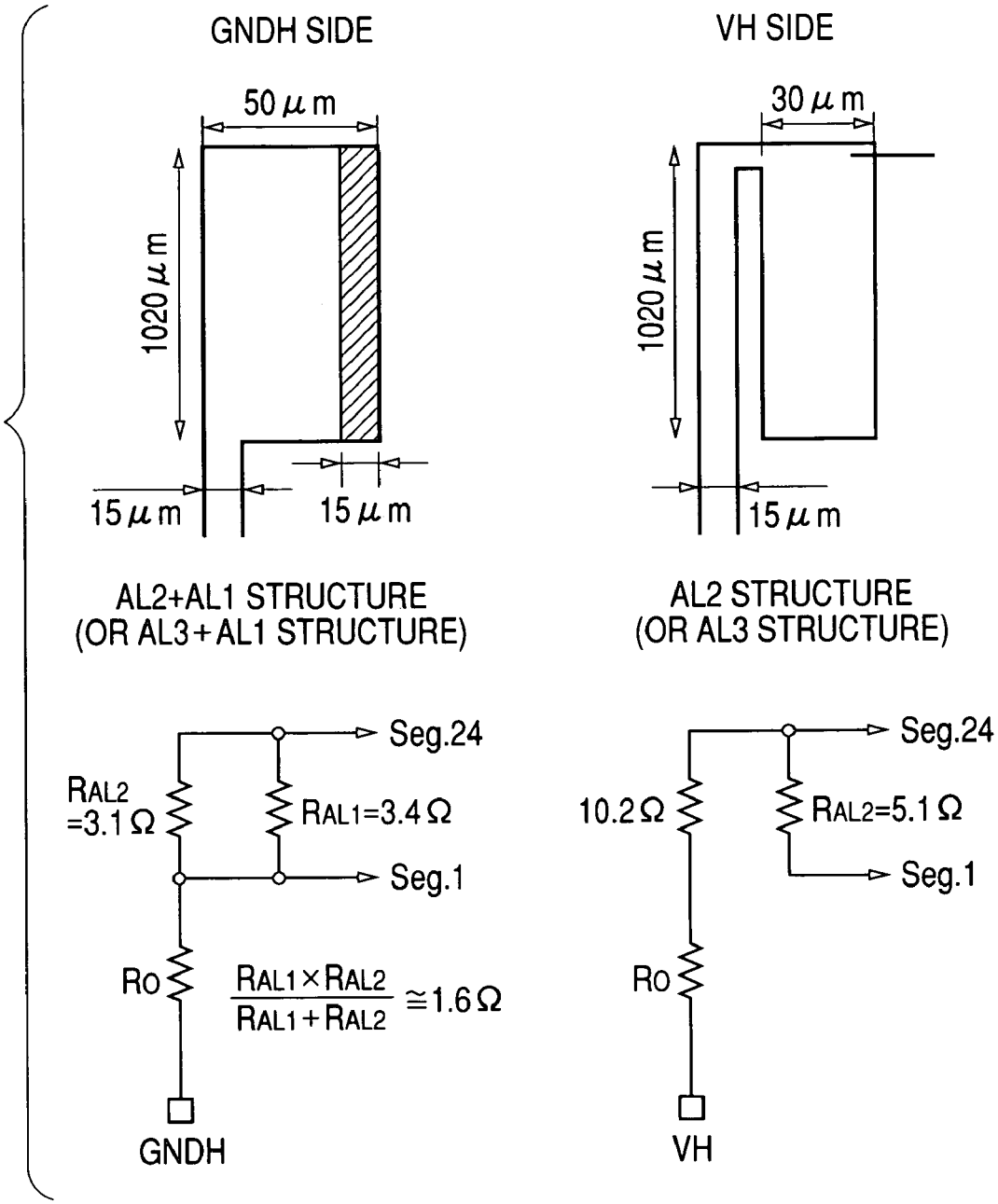
FIG. 18 is a view showing a layout image of the GNDH wiring and the VH wiring within the segment of FIG. 17 and an equivalent circuit view of a wiring resistance.

FIG. 18 shows a layout image of the GNDH wiring and the VH wiring within the segment and an equivalent circuit of a parasitic resistance (wiring resistance) in the case where one segment is constituted by 24 pieces of heater. This equivalent circuit is calculated by taking a sheet resistance $\rho_{AL1}$ of the aluminum wiring layer AL1 of the first layer as $\rho_{AL1}$=0.05Ω/□, and a sheet resistance $\rho_{AL23}$ of the aluminum wiring layer AL2 of the second layer or the aluminum wiring layer AL3 of the third layer as $\rho_{AL23}$=0.15Ω/□. With respect to the sheet resistance value used here, the reason why the value of the second layer is higher than the value of the first layer is because, while in case of the recording head to eject an ink by using heat energy, since a nozzle unit constituting an ink flow path and a liquid chamber is constituted on the recording head, the film thickness of the wiring layer AL2 of the second layer or the film thickness of the wiring layer AL3 of the third layer has a tendency to become thinner than the film thickness of the wiring layer AL1 of the first layer in consideration of the step on the surface of the recording head after wiring process. The wiring resistance value at this time from the pads in the first heater #1 and 24th heater #24 is as shown in the following table 3. A resistance Ro is a wiring resistance of the VH wiring and the GNDH wiring from the bonding pad to its segment.

TABLE 3

| | GNDH wiring resistance [Ω] | VH wiring resistance [Ω] | (GDNH + VH) wiring resistance [Ω] |
|---|---|---|---|
| Heater #24 | Ro + 1.6 | Ro + 10.2 | 2Ro + 11.8 |

TABLE 3-continued

| | GNDH wiring resistance [Ω] | VH wiring resistance [Ω] | (GDNH + VH) wiring resistance [Ω] |
|---|---|---|---|
| Heater #1 | Ro | Ro + 10.2 + 5.1 | 2Ro + 15.3 |

From Table 3, a difference ΔR of the (GNDH+VH) wiring resistance between the heater #24 and the heater #1 becomes 3.5Ω.

As a method for further reducing this difference ΔR of the wiring resistance, there is a method conceivable where a power source wiring width of the wiring layer AL2 of the second layer or the wiring layer AL3 of the third layer at the VH wiring side is widened and the resistance value is matched. However, such a method cannot be realized sometimes because of the limitation of the substrate size of the recording head.

Further, as another reducing method, there is a method conceivable where the wiring width of the wiring layer AL2 of the second layer or the wiring layer AL3 of the third layer at the GNDH wiring side is made small, and is matched to the resistance value of the VH wiring side. However, since the resistance of the GNDH wiring is made high, a source potential of the power transistor is raised, and the resistance value at the ON time of the power transistor is made high. This means ineffective power consumption other than energy for ejecting the ink, and is unable to be simply executed in view of an energy saving.

As a method for reducing the difference ΔR of the wiring resistance other than the above described method, there is a method conceivable where the wiring resistance value of the VH wiring side is matched to the resistance value of the GNDH wiring side at a location other than the wiring layer AL2 of the second layer or the wiring layer AL3 of the third layer. Its layout is shown in FIG. 19.

Figure 19:
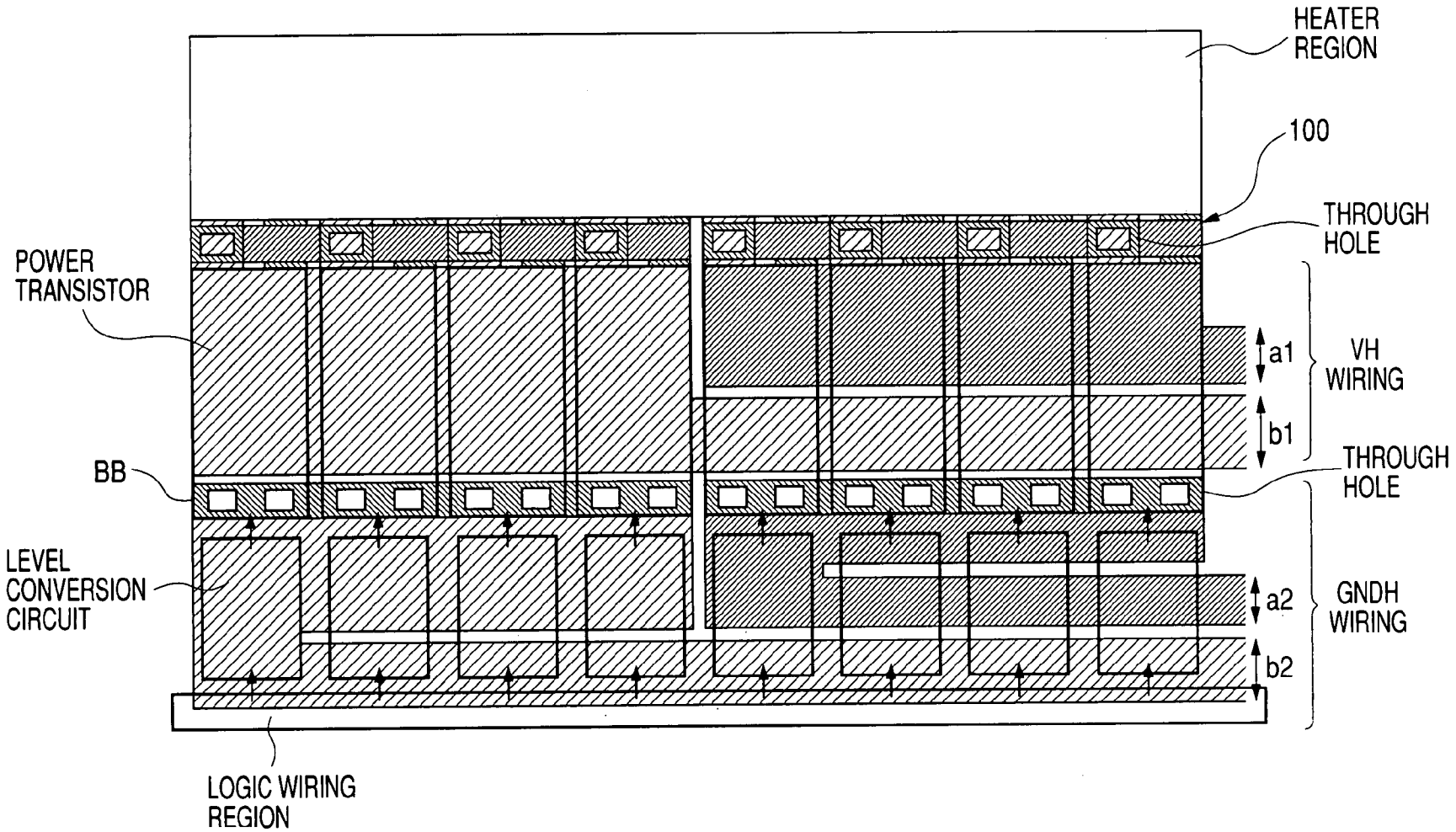
FIG. 19 is a view showing a modified example of the layout of FIG. 17.

The structure shown in FIG. 19 is different from the structure shown in FIG. 17 in that an auxiliary wiring 100 is further provided. The auxiliary wiring 100 is provided for each segment at a location interposed between the layout region of the heater 101 and the output end position (position of reference character AA) of the power transistor 102. The auxiliary wiring 100 is formed on the wiring layer other than the wiring layer AL2 of the second layer or the wiring layer AL3 of the third layer in a multi layer wiring, and mutually electrically connects the end portion of the VH wiring side of each heater within the segment through a through hole. This auxiliary wiring 100 is a wiring to match the wiring resistance value of the VH wiring side to the resistance value of the GDNH wiring side. Here, it is preferable that the wiring layer constituting the auxiliary wiring 100 is the wiring layer AL2 of the second layer or the wiring layer AL3 of the third layer that is a wiring layer in which a part of the GNDH wiring side wiring is formed. Further, it is desirable that the wiring width of the auxiliary wiring 100 is equal to the resistance value of a portion which connects the source of the power transistor in the wiring layer AL1 of the first layer.

Figure 20:
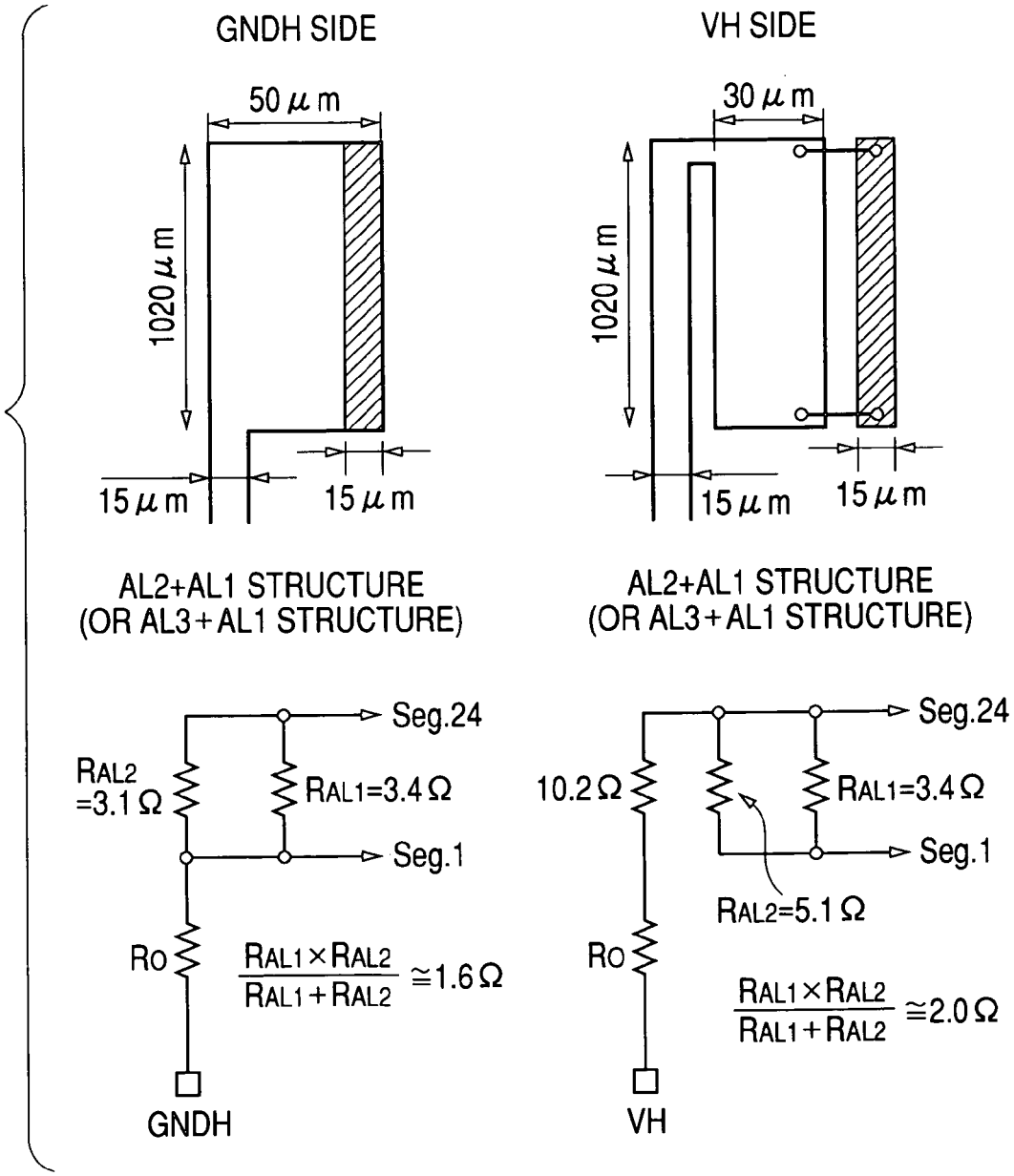
FIG. 20 is a view showing a layout image of the GNDH wiring and the VH wiring within the segment of FIG. 19 and an equivalent circuit view of a wiring resistance.

FIG. 20 shows the layout image of the GNDH wiring and the VH wiring within the segment and the equivalent circuit of the parasitic resistance (wiring resistance) in case of providing the auxiliary wiring 100 as shown in FIG. 19. In FIG. 20, similarly to the segment shown in FIG. 18, one segment is constituted by 24 pieces of heater, and when the equivalent circuit is calculated, the sheet resistance $\rho_{AL1}$ of the wiring layer AL1 of the first layer is taken as $\rho_{AL1}$=0.05Ω/□, and the sheet resistance $\rho_{AL23}$ of the aluminum wiring layer AL2 of the second layer or the wiring layer AL3 of the third layer is taken as $\rho_{AL23}$=0.15Ω/□. The wiring resistance value at this time from the pads in the first heater #1 and the 24th heater #24 is as shown in the following table 4.

TABLE 4

| | GNDH wiring resistance [Ω] | VH wiring resistance [Ω] | (GDNH + VH) wiring resistance [Ω] |
|---|---|---|---|
| Heater #24 | Ro + 1.6 | Ro + 10.2 | 2Ro + 11.8 |
| Heater #1 | Ro | Ro + 10.2 + 2.0 | 2Ro + 12.2 |

As evident from Table 4, by providing the auxiliary wiring 100, it is possible to reduce the difference ΔR of the wiring resistance between the heater #24 and the heater #1 up to 0.4Ω. Naturally, if there is an allowance in the space possible to lay out, the width of a resistance dowelling auxiliary wiring 100 may be widened, thereby allowing the difference ΔR of the wiring resistance between the heater #24 and the heater #1 to further approach zero.

As described above, in the present embodiment, by providing the auxiliary wiring 100, the wiring resistance values within the segment can be effectively matched without making a substrate size of the recording head remarkably large. Further, even when there is a change of the film thickness of the wiring layer in the wiring layers AL1 or AL2 or AL3, there is such a feature also available that the irregularity of the wiring resistance value within the segment is hard to be affected by the change of the film thickness.

Further, in the above described embodiment, though the case of the wiring layer being two or three layers has been described, the present invention can cope with the case where the wiring is provided more. The present invention is suitably applied to a structure where one terminal of a switch device is commonly connected by the wiring for every segment, and a wiring corresponding to the wiring commonly connected is provided as an auxiliary wiring.

(Recording Head and Ink Jet Recording Apparatus Using the Recording Head)

Next, on condition that an ink jet recording head base substance is constituted by the above described circuit structure by building the heater, the power transistor, the drive logic circuit unit, the VH wiring, the GNDH wiring and the like into the semiconductor substrate, the recording head using such a head base substance and an ink jet recording apparatus using such a recording head will be described.

Figure 9:
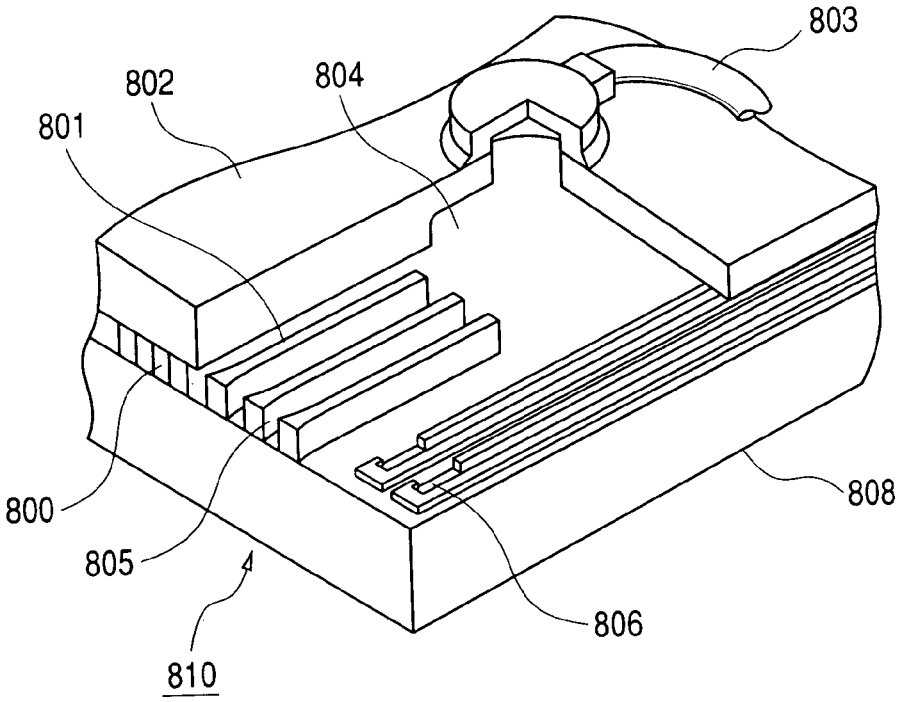
FIG. 9 is a perspective view showing a detailed structure of an ink jet recording head.

FIG. 9 shows essential components of a recording head 810 having an ink jet recording head base substance 808 as described above. Here, the above described heater 101 is depicted as a heat generating unit 806. As shown in FIG. 9, the base substance 808 can constitute the recording head 810 by combining a fluid path wall member 801 for forming a liquid path 805 communicated to a plurality of ejection orifices 800 and a top plate 802 having an ink supply orifice 803. In this case, the ink poured from the ink supply orifice 803 is stored in an inner common liquid chamber 804, and is supplied to each liquid path 805, and with this state kept, the base substance 808 and the heat generating unit 806 are driven, so that the ink is ejected from the ejection orifice 800.

Figure 10:
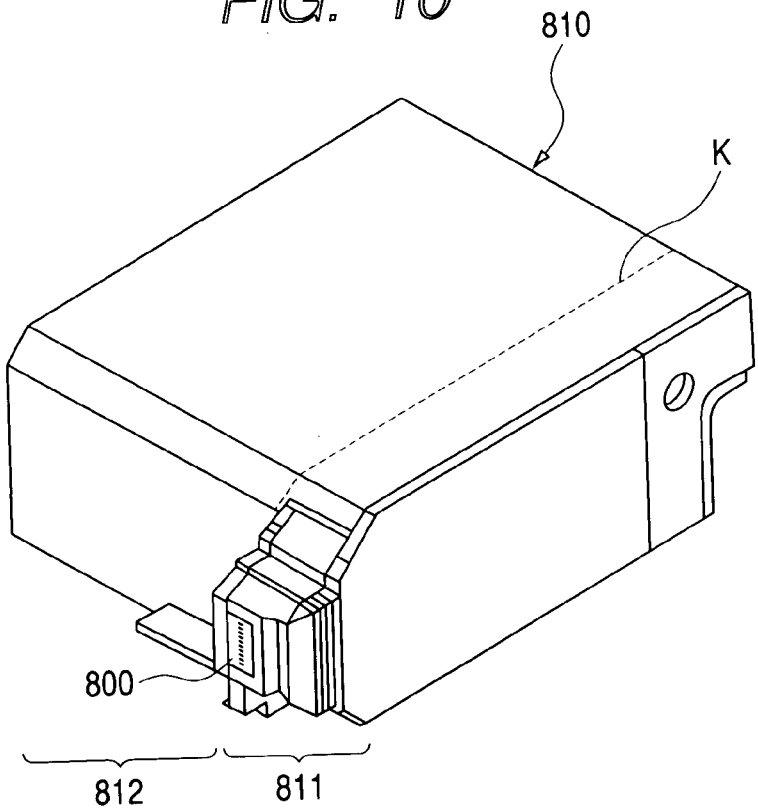
FIG. 10 is a perspective view showing the ink jet recording head constituted as an ink jet recording cartridge.

FIG. 10 is a view showing a whole structure of such an ink jet recording head 810. The ink jet recording head 810 comprises the recording head unit 811 having a plurality of the above described ejection orifices 800 and an ink container 812 for holding the ink to be supplied to this recording head unit 811. The ink container 812 is provided detachably attachable to the recording head unit 811 with a boundary line K as a boundary. In the ink jet recording head 810, there is provided an electric contact (not shown) for receiving an electric signal from a carriage side when mounted on a recording apparatus shown in FIG. 11, and by this electric signal, the heater is driven. In the interior of the ink container 812, there are provided fibrous or spongy ink absorbers, and by these ink absorbers, the ink is held.

By mounting the recording head 810 shown in FIG. 10 on the ink jet recording apparatus main body and controlling a signal given to the recording head 810 from the apparatus main body, it is possible to provide the ink jet recording apparatus capable of realizing a high speed recording and a high quality image recording. The ink jet recording apparatus using such a recording head 810 will be described below.

Figure 11:
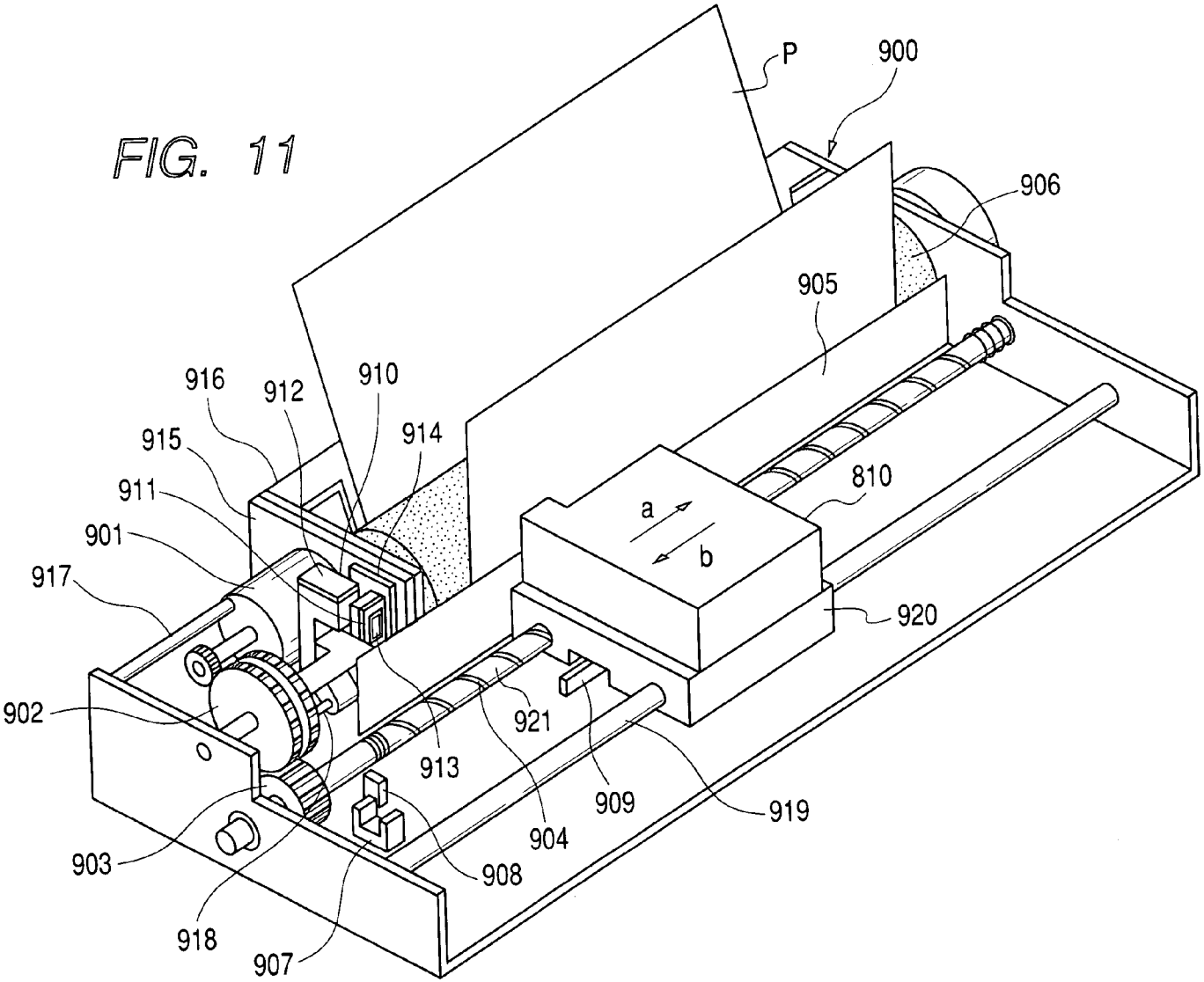
FIG. 11 is an outside perspective view showing an ink jet recording apparatus according to the present invention.

FIG. 11 is an outside perspective view showing an ink jet recording apparatus 900 of the embodiment according to the present invention.

In FIG. 11, the recording head 810 is mounted on a carriage 920 engaged with a helical groove 921 of a lead screw 904 which rotates through transfer gears 902 and 903 by associating with a reciprocal rotation of a drive motor 901, and is reciprocally movable with the carriage 920 by the driving force of the drive motor 901 alongside a guide 919 in the direction of arrow marks a or b. A paperweight plate 905 for use of a recording paper P conveyed on a platen 906 by an unillustrated recording medium conveying apparatus presses the recording paper P against the platen 906 along a carriage moving direction.

Photo couplers 907 and 908 are home position detecting means for recognizing the existence of a lever 909 provided on the carriage 920 in the region where the photo couples 907 and 908 are provided and performing a changeover of the rotational direction of the driving motor 901 and the like. A support member 910 supports a cap member 911 for capping a whole surface of the recording head 810, and absorbing means 912 absorbs the interior of the cap member 911 and performs a suction recovery of the recording head 810 through a cap inner opening 513. A moving member 915 can move a cleaning blade 914 back and forth, and the cleaning blade 914 and the moving member 915 are supported by a main body support plate 916. Naturally, the cleaning blade 914 is not according to the illustrated embodiment, but a known cleaning blade is applicable also to the present embodiment. Further, a lever 917 is provided in order to start s suction of the suction recovery, and moves accompanied with the movement of a cam 918 which engages with the carriage 920. The driving force from the driving motor 901 is move-controlled by known transfer means such as a clutch and the like. A recording control unit (not shown) for giving a signal to the heat generating unit 806 provided in the recording head 810 and managing a drive control of each mechanism such as the driving motor 901 and the like is provided on the apparatus main body side.

The ink jet recording apparatus 900 as described above allows a recording to be performed while the recording head 810 makes a reciprocating movement across a full width of the recording paper for the recording paper P conveyed on the platen 906 by a recording medium conveying apparatus, and since the recording head 810 is manufactured by using the ink jet recording head base substance having a circuit structure of each embodiment, a highly accurate and high speed recording is made possible.

Figure 12:
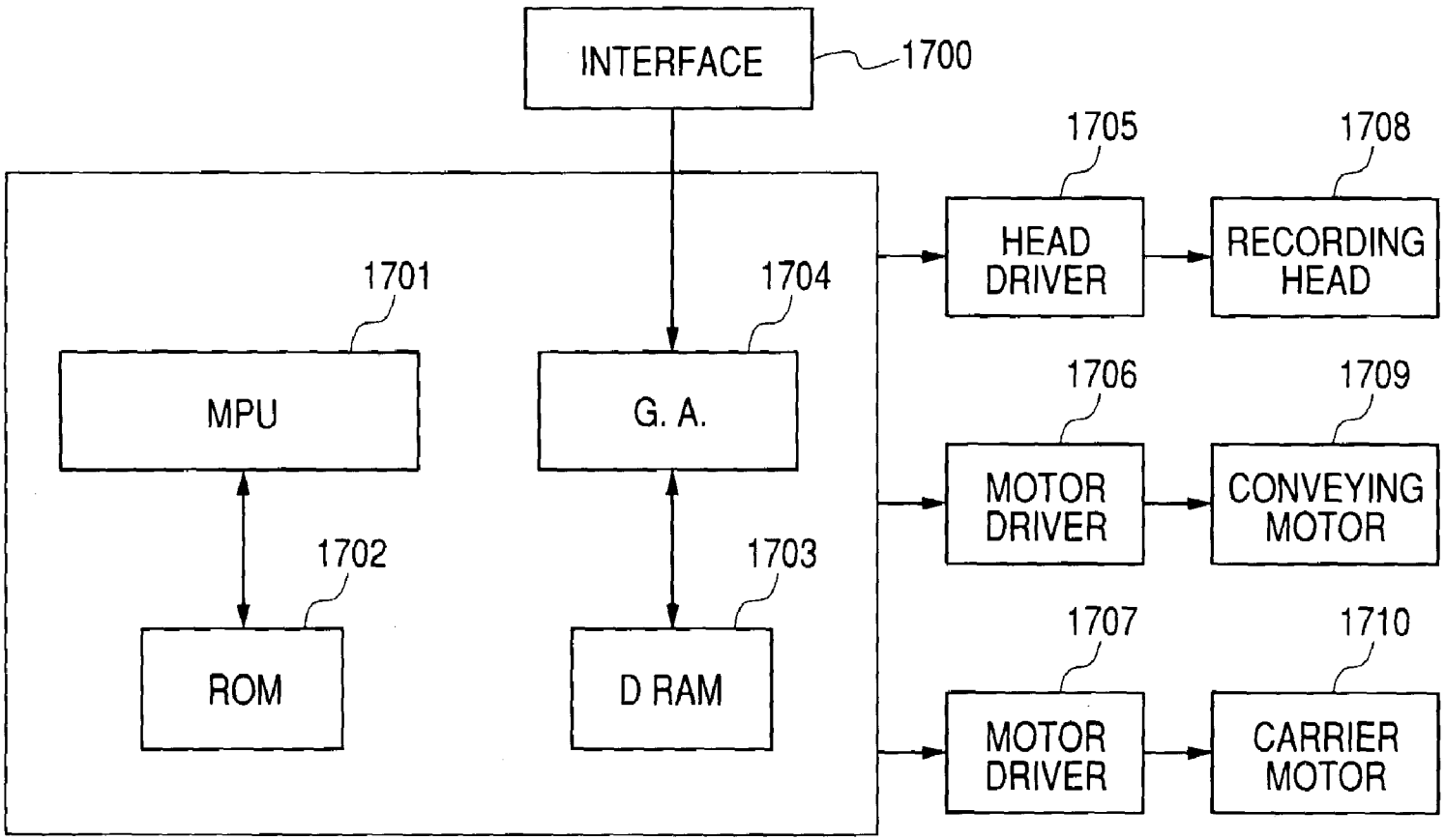
FIG. 12 is a block diagram showing the structure of a control circuit of the ink jet recording apparatus.

Next, the structure of a control circuit for executing a recording control of the above described apparatus will be described. FIG. 12 is a block diagram showing the structure of the control circuit of the ink jet recording apparatus 900. The control circuit comprises an interface 1700 inputted with a recording signal, a MPU (microprocessor) 1701, a program ROM 1702 storing a control program executed by the MPU 1701, a dynamic type RAM (random access memory) 1703 storing various data (recording data and the like supplied to the above described signal and head), and a gate array 1704 for performing a supply control of the recording data for a recording head 1708. The gate array 1704 performs a data transfer control also among the interface 1700, the MPU 1701 and the RAM 1703. Further, this control circuit comprises a carrier motor 1710 for conveying the recording head 1708, a conveying motor 1709 for conveying the recording paper, a head driver 1705 for driving the head 1708, and motor drivers 1706 and 1707 for driving the conveying motor 1709 and the carrier motor 1710, respectively.

Describing the operation of the above described control circuit, when a recording signal is inputted to the interface 1700, the recording signal is converted into a print recording data between the gate array 1704 and the MPU 1701. Then, the motor drivers 1706 and 1707 are driven, and at the same time, the recording head is driven according to the recording data sent to the head driver 1705, and a printing is performed.

The present invention brings about an excellent effect in the recording head and the recording apparatus of the system for ejecting the ink by using heat energy, which is advocated by the present applicant particularly from among the ink jet recording systems.

As for its representative structure and principle, it is preferable that the basic principles disclosed, for example, in U.S. Pat. Nos. 4,723,129 and 4,740,796 are used and applied. This method is applicable to either of a so-called on-demand type or continuous type, but particularly effective in case of the on-demand type where, by applying at least one drive signal corresponding to recording information and giving a rapid rise in temperature exceeding the boiling to an electrothermic exchanger arranged by corresponding to the sheet holding the liquid (ink) and the liquid path, heat energy is developed in the electrothermic exchanger, and a film boiling is generated on a heat operating surface of the recording head, which eventually corresponds to the drive signal at one to one correspondence, thereby forming a bubble within the liquid (ink). By this growth and contraction of the bubble, the liquid (ink) is ejected through an ejection orifice opening, so that at least one droplet is formed. When this drive signal is taken as a pulse shape, the growth and the contraction of the bubble is appropriately effected at once, and therefore, an ejection of the liquid (ink) particularly excellent in response can be achieved, and this is preferable. As the driving signal of this pulse shape, a signal such as disclosed in U.S. Pat. Nos. 4,463,359 and 4,345,262 is suitable. When the condition disclosed in U.S. Pat. No. 4,313,124 relating to the rate of rise in temperature of the heat operating surface is adopted, more excellent recording can be performed.

As a structure of the recording head, in addition to the combined structure (linear liquid flow path or perpendicular liquid flow path) of the ejection orifice, the liquid path and the eletrothermic exchanger such as disclosed in each of the above described specifications, the structure using U.S. Pat. Nos. 4,558,333 and 4,459,600 disclosing a structure arranged in the region where a thermal action unit is bent are also included in the present invention. In addition, the structures based on Japanese Patent Laid-Open No. S59-123670 disclosing a structure wherein common slits are taken as an ejection unit of the electrothermic exchanger for a plurality of electrothermic exchangers, and Japanese Patent Application Laid-Open No. S59-138461 disclosing a structure wherein an opening to absorb a pressure wave of heat energy is allowed to correspond to an ejection unit are also effective to the present invention.

Further, as a recording head of the full line type having the length corresponding to the width of the maximum recording medium recordable by the recording apparatus, though either of the structure satisfying its length by the combination of a plurality of recording heads as disclosed in the above described specifications or the structure integrally formed as a piece of recording head is preferable, the present invention can demonstrate the above described effect more effectively.

The present invention is applicable to the above described embodiment the modification or the alternation thereof without departing from the spirit of the invention.

The present invention may be adapted to a system consisting of a plurality of equipment (for example, such as a host computer, an interface equipment, a reader, a printer and the like) or a device comprising one equipment (for example, such as a copier, a facsimile machine and the like).

This application claims priority from Japanese Patent Application No. 2003-315532 filed on Sep. 8, 2003, which is hereby incorporated by reference herein.

What is claimed is:

1. A semiconductor device for a liquid ejection head having a plurality of recording elements and driving elements provided correspondingly to every said recording element for driving the recording elements, said semiconductor device having at least a first wiring layer and a second wiring layer formed on a semiconductor substrate, wherein a segment is formed by a plurality of pairs of said recording element and said driving element, and a first wiring for mutually connecting and grounding first terminals of said driving elements arranged within the same segment is formed on said first wiring layer, wherein a second terminal of said driving element and the first terminal of said recording element are connected on one for one base, wherein a power source wiring is formed by said second wiring layer on the second terminal of said recording element so that the current is let flow into said recording element by a control signal inputted to a third terminal of said driving element, and wherein an auxiliary wiring for mutually connecting the second terminal of said recording element arranged within the same segment is formed by said first wiring layer.

2. The semiconductor device according to claim 1, wherein said recording element is a heater, and said driving element is a power transistor, and the second terminal of said recording element and the second terminal of said driving element are mutually connected for every said pair.

3. The semiconductor device according to claim 1, wherein said power source wiring is provided for every segment, and a GND wiring connected to said first wiring of said segment through a through hole is formed on said second wiring layer for every said segment.

4. The semiconductor device according to claim 3, wherein a first bonding pad connected to said each power source wiring and a second bonding pad connected to said each GND wiring are provided on said semiconductor substrate, and wiring widths of said power source wiring and said GND wiring for every segment are selected so that a wiring resistance reaching to said second bonding pad from said first bonding pad through said power source wiring, said pairs and said GND wiring is uniformized without depending on the segment.

5. The semiconductor device according to claim 1, wherein a block is constituted by the arbitrary number of said pairs, and said recording element is time-division driven for every said block.

6. The semiconductor device according to claim 5, wherein said each segment constitutes said block.

7. The semiconductor device according to claim 1, wherein a shift register for outputting an image data inputted in series in parallel and a latch circuit for temporarily storing a data outputted from said shift register are provided on said semiconductor substrate.

8. A liquid ejection head, comprising the semiconductor device according to claim 1 and a member combined into the semiconductor device for forming an ejection orifice integral with a liquid path and one end of the liquid path associated with said recording element.

9. A liquid ejection apparatus, comprising the liquid ejection head according to claim 8 and means for relatively conveying a print medium to the liquid ejection head.

10. The liquid ejection apparatus according to claim 9, comprising a carriage for detachably attachably supporting said liquid ejection head and scanning against said print medium.

11. A semiconductor device for a liquid ejection head having a plurality of recording elements and driving elements provided correspondingly to every said recording element for driving the recording elements, said semiconductor device having a plurality of wiring layers formed on a semiconductor substrate, a segment being formed by a plurality of pairs of said recording element and said driving element, and a first wiring for mutually connecting a first terminal of said each driving element arranged within the same segment being formed on a first wiring layer, a second terminal of said driving element and the first terminal of said recording element being connected on one for one base, wherein a power source wiring which is formed by the wiring layer different from said first wiring layer is connected to the second terminal of said recording element, and wherein an auxiliary wiring for mutually connecting the second terminal of said recording element arranged within the same segment is formed by said first wiring layer.

12. The liquid ejection head semiconductor device according to claim 11, wherein said power source wiring is formed by at least two wiring layers according to the segment.

13. A liquid ejection head, comprising the semiconductor device according to claim 11 and a member combined into the liquid ejection head semiconductor device for forming an ejection orifice integral with a liquid path and one end of the liquid path associated with said recording element.

14. A liquid ejection apparatus, comprising the liquid ejection head according to claim 13 and means for relatively conveying a print medium to the liquid ejection head.

15. The liquid ejection apparatus according to claim 14, further comprising a carriage for detachably attachably supporting said liquid ejection head and scanning against said print medium.

* * * * *

UNITED STATES PATENT AND TRADEMARK OFFICE

CERTIFICATE OF CORRECTION

PATENT NO. : 7,125,105 B2
APPLICATION NO. : 10/933379
DATED : October 24, 2006
INVENTOR(S) : Masanobu Oomura It is certified that error appears in the above-identified patent and that said Letters Patent is hereby corrected as shown below:

COLUMN 1
Line 31, “by” should read --by an--.
Line 61, “resister” should read --register--.
Line 62, “one each” should read --one of each--.
Line 63, “resister” should read --register--.
Line 66, “resistor” should read --register--.

COLUMN 2
Line 53, delete “much”.

COLUMN 3
Line 51, delete “of the”.

COLUMN 4
Line 23, “is” should read --are--.
Line 27, “providing” should read --provided--.
Line 38, “heat” should read --heater--.

COLUMN 5
Line 13, “elements,” should read --element,--.

COLUMN 7
Line 8, “for an ink” should read --for ink--.
Line 19, “one for one base” should read --on a one-for-one basis--.

COLUMN 8
Line 6, “multi layer” should read --multi-layer--.
Line 15, “multi” should read --multi- --.
Line 50, “heater 1010N” should read --101 ON--.

COLUMN 10
Line 65, “one for one base” should read --on a one-for-one basis--.

UNITED STATES PATENT AND TRADEMARK OFFICE

CERTIFICATE OF CORRECTION

PATENT NO. : 7,125,105 B2
APPLICATION NO. : 10/933379
DATED : October 24, 2006
INVENTOR(S) : Masanobu Oomura It is certified that error appears in the above-identified patent and that said Letters Patent is hereby corrected as shown below:

COLUMN 11
Line 55, “after” should read --after the--.
Line 64, Table 1, “(GDNH + VH) wiring” should read --(GNDH + VH) wiring--.

COLUMN 12
Line 3, Table 1, “(GDNH + VH) wiring” should read --(GNDH + VH) wiring--.
Line 41, “multi layer” should read --multi-layer--.
Line 62, “firs” should read --first--.

COLUMN 13
Line 4, Table 2, “(GDNH + VH) wiring” should read --(GNDH + VH) wiring--.
Line 63, “layer AL2” should read --layer AL3--.

COLUMN 14
Line 55, “after” should read --after the--.
Line 64, Table 3, “(GDNH + VH) wiring” should read --(GNDH + VH) wiring--.

COLUMN 15
Line 3, Table 3, “(GDNH + VH) wiring” should read --(GNDH + VH) wiring--.
Line 46, “multi layer” should read --multi-layer--.
Line 51, “GDNH wiring” should read --GNDH wiring--.

COLUMN 16
Line 10, Table 4, “(GDNH + VH) wiring” should read --(GNDH + VH) wiring--.

UNITED STATES PATENT AND TRADEMARK OFFICE

CERTIFICATE OF CORRECTION

PATENT NO. : 7,125,105 B2
APPLICATION NO. : 10/933379
DATED : October 24, 2006
INVENTOR(S) : Masanobu Oomura It is certified that error appears in the above-identified patent and that said Letters Patent is hereby corrected as shown below:

COLUMN 17
Line 36, "couples" should read --couplers--.
Line 50, delete "s".

COLUMN 19
Line 20, "embodiment" should read --embodiment,--.

Signed and Sealed this

Twenty Second Day of April, 2008

JON W. DUDAS
*Director of the United States Patent and Trademark Office*